US009293286B2

(12) United States Patent
Saito et al.

(10) Patent No.: US 9,293,286 B2
(45) Date of Patent: Mar. 22, 2016

(54) ELECTROMAGNETIC RELAY

(71) Applicant: FUJITSU COMPONENT LIMITED, Tokyo (JP)

(72) Inventors: Yasushi Saito, Tokyo (JP); Akihiko Nakamura, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/644,672

(22) Filed: Mar. 11, 2015

(65) Prior Publication Data

US 2015/0187526 A1 Jul. 2, 2015

Related U.S. Application Data

(62) Division of application No. 13/951,905, filed on Jul. 26, 2013, now Pat. No. 9,007,155.

(30) Foreign Application Priority Data

Aug. 31, 2012 (JP) ..... 2012-192156

(51) Int. Cl.

| | |
|---|---|
| ***H01H 51/22*** | (2006.01) |
| ***H01H 51/04*** | (2006.01) |
| ***H01H 50/30*** | (2006.01) |
| ***H01H 50/54*** | (2006.01) |

(52) U.S. Cl.

CPC ..... *H01H 51/04* (2013.01); *H01H 50/305* (2013.01); *H01H 50/54* (2013.01)

(58) Field of Classification Search

CPC ..... H01H 50/34

USPC ..... 335/78

See application file for complete search history.

(56) References Cited

U.S. PATENT DOCUMENTS

| | | | | |
|---|---|---|---|---|
| 2,354,162 | A * | 7/1944 | Weber | 335/35 |
| 2,373,256 | A * | 4/1945 | Miller | 290/38 R |
| 2,505,225 | A * | 4/1950 | Akroyd | 335/187 |
| 2,516,027 | A * | 7/1950 | Stuellein et al. | 335/23 |
| 2,700,079 | A * | 1/1955 | Haydon | 200/460 |

(Continued)

FOREIGN PATENT DOCUMENTS

JP 2011-81961 4/2011

OTHER PUBLICATIONS

U.S. Appl. No. 13/951,905, filed Jul. 26, 2013, Yasushi Saito et al., Fujitsu Component Limited.

(Continued)

*Primary Examiner* — Alexander Talpalatski

(74) *Attorney, Agent, or Firm* — Staas & Halsey LLP

(57) ABSTRACT

An electromagnetic relay including an electromagnet, a movable contact actuated by the electromagnet, and a fixed contact disposed opposite to the movable contact and capable of contacting and separating from the movable contact. The electromagnetic relay further includes a backstop for stopping movement of the movable contact in a direction separating from the fixed contact, and a backstop positioner for setting the backstop at a position for defining a predetermined contact gap between the fixed contact and the movable contact. In a state where movement of the movable contact is stopped by the backstop, different-sized contact gaps are defined between the fixed contact and the movable contact, depending on the position of the backstop set by the backstop positioner.

5 Claims, 14 Drawing Sheets

(56) References Cited

U.S. PATENT DOCUMENTS

| | | | | | |
|---|---|---|---|---|---|
| 2,863,102 | A | * | 12/1958 | Zupa | 335/276 |
| 3,748,611 | A | * | 7/1973 | Heath | 335/197 |
| 3,858,017 | A | * | 12/1974 | Bertozzi et al. | 200/574 |
| 4,081,632 | A | * | 3/1978 | Schaffeler | 200/6 BB |
| 4,258,344 | A | * | 3/1981 | Nishimi | 335/129 |
| 4,490,768 | A | * | 12/1984 | Mori et al. | 361/2 |
| 5,332,985 | A | * | 7/1994 | Hendel | 335/78 |
| 5,359,305 | A | * | 10/1994 | Kitamura et al. | 335/78 |
| 5,382,934 | A | * | 1/1995 | Hendel et al. | 335/159 |
| 5,402,092 | A | * | 3/1995 | Bagalini | 335/242 |
| 5,493,091 | A | * | 2/1996 | Devautour et al. | 218/30 |
| 5,696,475 | A | * | 12/1997 | Yoshitani et al. | 335/78 |
| 6,771,154 | B1 | * | 8/2004 | Funayama et al. | 335/159 |
| 7,477,119 | B2 | * | 1/2009 | Wu | 335/83 |
| 7,705,700 | B2 | * | 4/2010 | Parker et al. | 335/86 |
| 7,859,371 | B2 | * | 12/2010 | Takano | 335/78 |
| 2006/0181376 | A1 | * | 8/2006 | Mikl et al. | 335/78 |

OTHER PUBLICATIONS

Office Action issued Oct. 10, 2013 in U.S. Appl. No. 13/951,905.
Office Action issued Feb. 3, 2014 in U.S. Appl. No. 13/951,905.
Office Action issued May 29, 2014 in U.S. Appl. No. 13/951,905.
Office Action issued Oct. 29, 2014 in U.S. Appl. No. 13/951,905.
Notice of Allowance issued Dec. 12, 2014 in U.S. Appl. No. 13/951,905.

* cited by examiner

ELECTROMAGNETIC RELAY

CROSS-REFERENCE TO RELATED APPLICATIONS

This application is a divisional application of U.S. Ser. No. 13/951,905 filed Jul. 26, 2013, and is based upon and claims the benefit of priority of the prior Japanese Application No. 2012-192156, filed Aug. 31, 2012, the entire contents of which are incorporated herein by reference.

BACKGROUND OF THE INVENTION

1. Field of the Invention

The present invention relates to an electromagnetic relay.

2. Description of the Related Art

It is known in the art to produce an electromagnetic relay of a type appropriate for an electric voltage or current applied to an electric circuit (hereinafter referred to as a load circuit) to be opened or closed by the relay, by changing, on a type-by-type basis, a shape, dimension, etc., of a contact and/or a contact terminal, as an essential component of the electromagnetic relay, and thereby appropriately adjusting a maximum spacing (hereinafter referred to as a contact gap) defined between mutually opposing contacts when the contacts open.

For example, an electromagnetic relay for opening or closing a high voltage circuit may be produced by enlarging a contact gap so as to suppress an arc discharge occurring between mutually opposing contacts when the circuit is opened. In some conventional high-voltage relays, in order to ensure a reliable opening or closing operation of a movable contact even with an enlarged contact gap, a design strategy to increase power consumption of a coil may be employed. As the power consumption of a coil increases, amount of heat generation of the electromagnetic relay may increase accordingly.

Japanese Unexamined Patent Publication No. 2011-081961 (JP2011-081961A) describes an electromagnetic relay capable of suppressing heat generation.

It is preferred to address changes in an electric voltage or current applied to a load circuit while ensuring a stable opening and closing operation of a contact in an electromagnetic relay, by way of minimum design change to the components of the electromagnetic relay and/or of the load circuit to be opened or closed by the electromagnetic relay.

SUMMARY OF THE INVENTION

One aspect of the present invention provides an electromagnetic relay comprising an electromagnet; a movable contact actuated by the electromagnet; a fixed contact disposed opposite to the movable contact and capable of contacting and separating from the movable contact; a backstop for stopping movement of the movable contact in a direction separating from the fixed contact; and a backstop positioner for setting the backstop at a position for defining a predetermined contact gap between the fixed contact and the movable contact, wherein, in a state where movement of the movable contact is stopped by the backstop, different-sized contact gaps are defined between the fixed contact and the movable contact, depending on the position of the backstop set by the backstop positioner.

Another aspect of the present invention provides an electric circuit comprising an electromagnetic relay and a load, wherein the electromagnetic relay comprises a first terminal provided with a first contact; a second terminal provided with a second contact; and a short-circuiting member capable of coming into contact with the first contact and the second contact in a separable manner and electrically interconnecting the first terminal and the second terminal, wherein the first terminal, the second terminal, the short-circuiting member and the load are mutually connected in series.

DESCRIPTION OF THE EMBODIMENT

Figure 1:
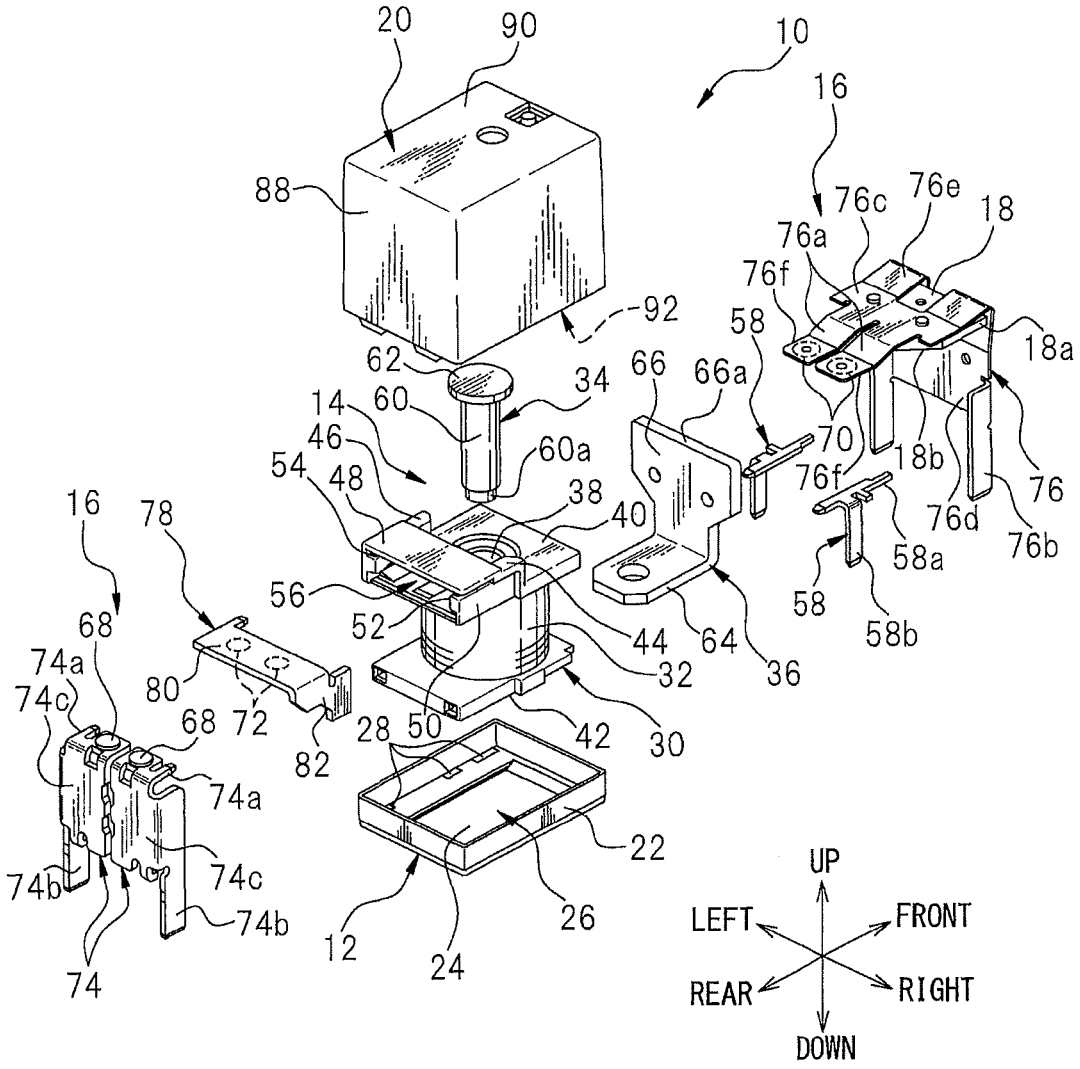
FIG. 1 is an exploded perspective view depicting an electromagnetic relay according to one embodiment.

The embodiments of the present invention are described below, in detail, with reference to the accompanying drawings. In the drawings, the same or similar components are denoted by common reference numerals.

In the following description, the terms expressing directions, such as "front", "rear", "forth", "back", "right", "left", "up", "down", "top", "bottom", etc., are used merely for descriptive purposes to provide a better understanding of the drawings, as additionally depicted in FIGS. 1, 2, 5 and 10, and are not intended to define any directional limitation when, e.g., actually used.

Figure 2:
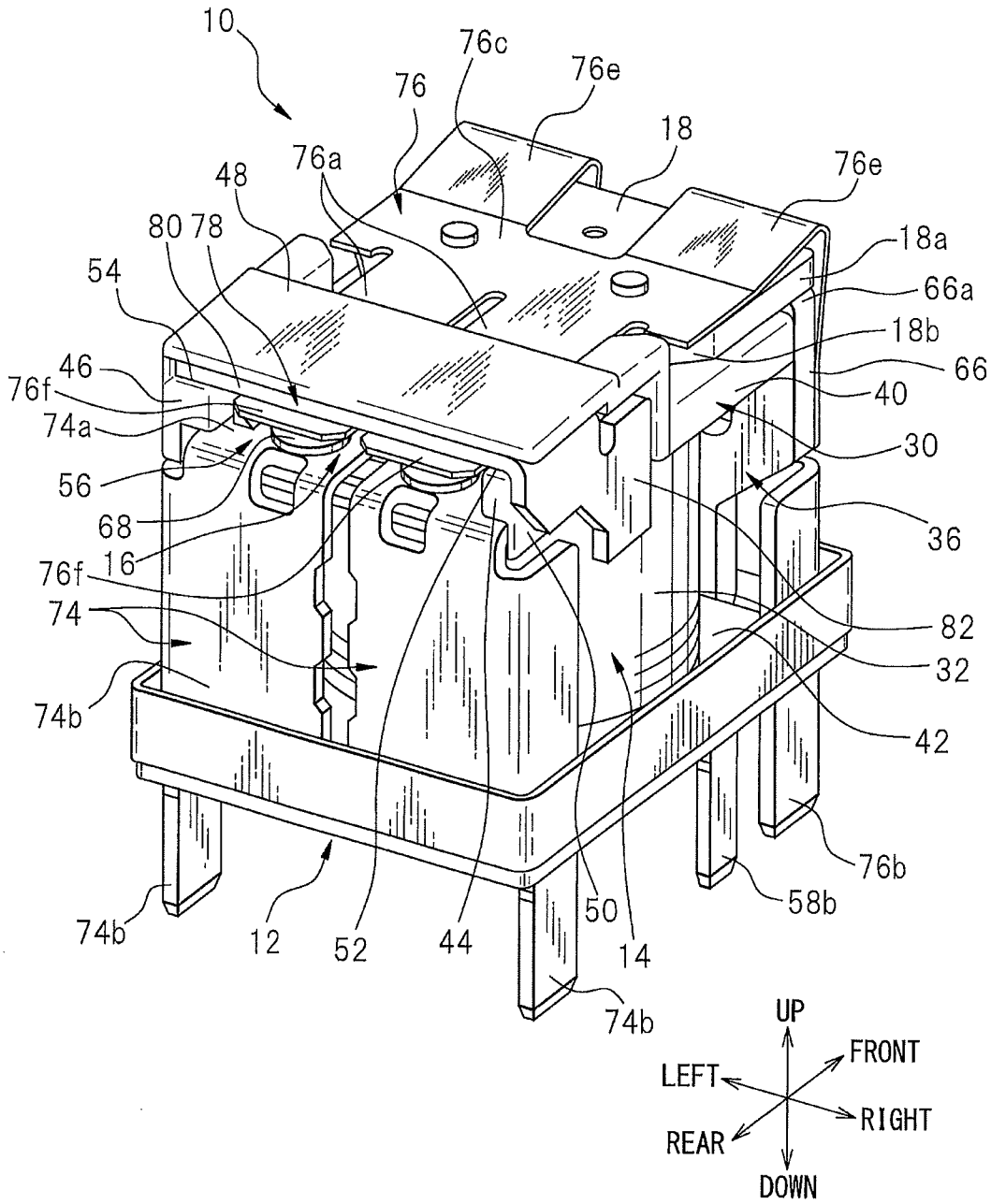
FIG. 2 is a perspective view depicting the electromagnetic relay of FIG. 1 in an assembled state with a cover removed.
Figure 3:
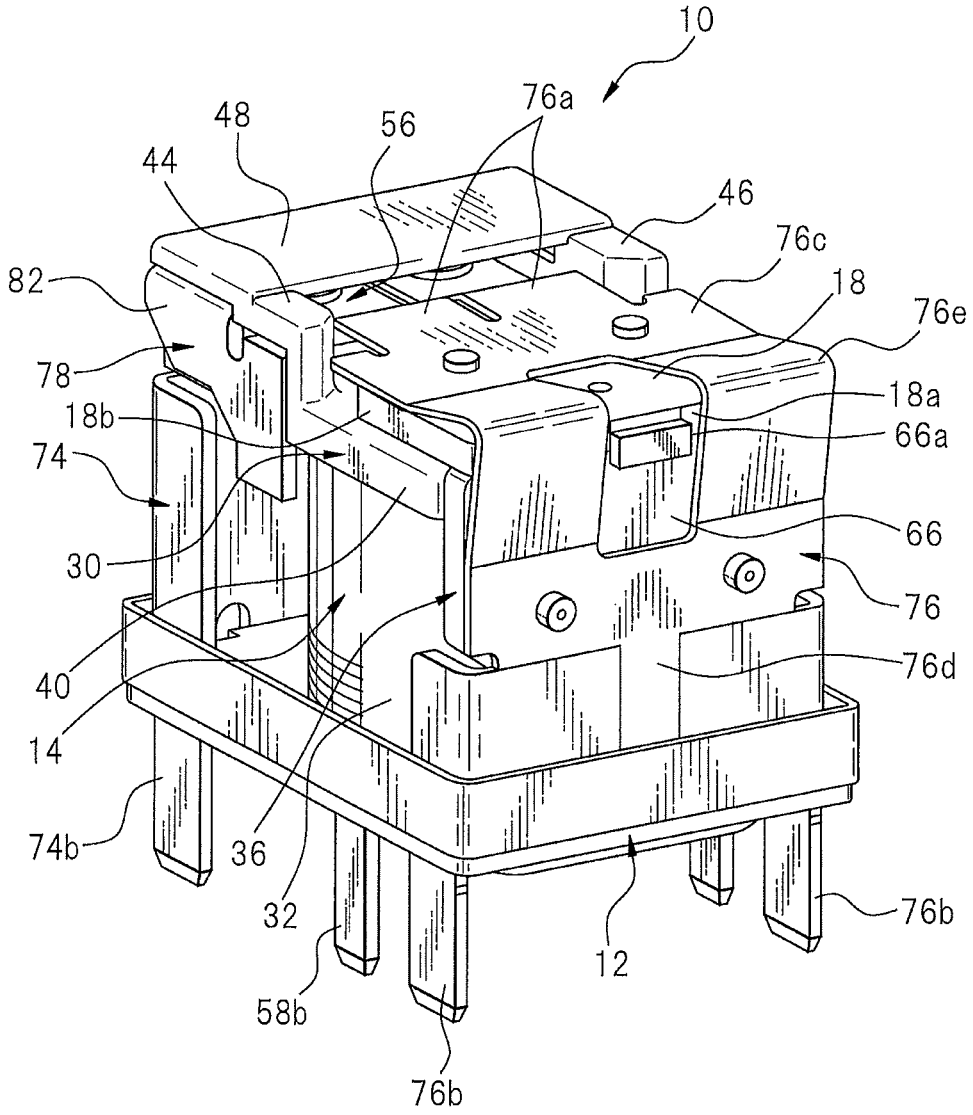
FIG. 3 is a perspective view depicting the electromagnetic relay of FIG. 2 in a different orientation.
Figure 4:
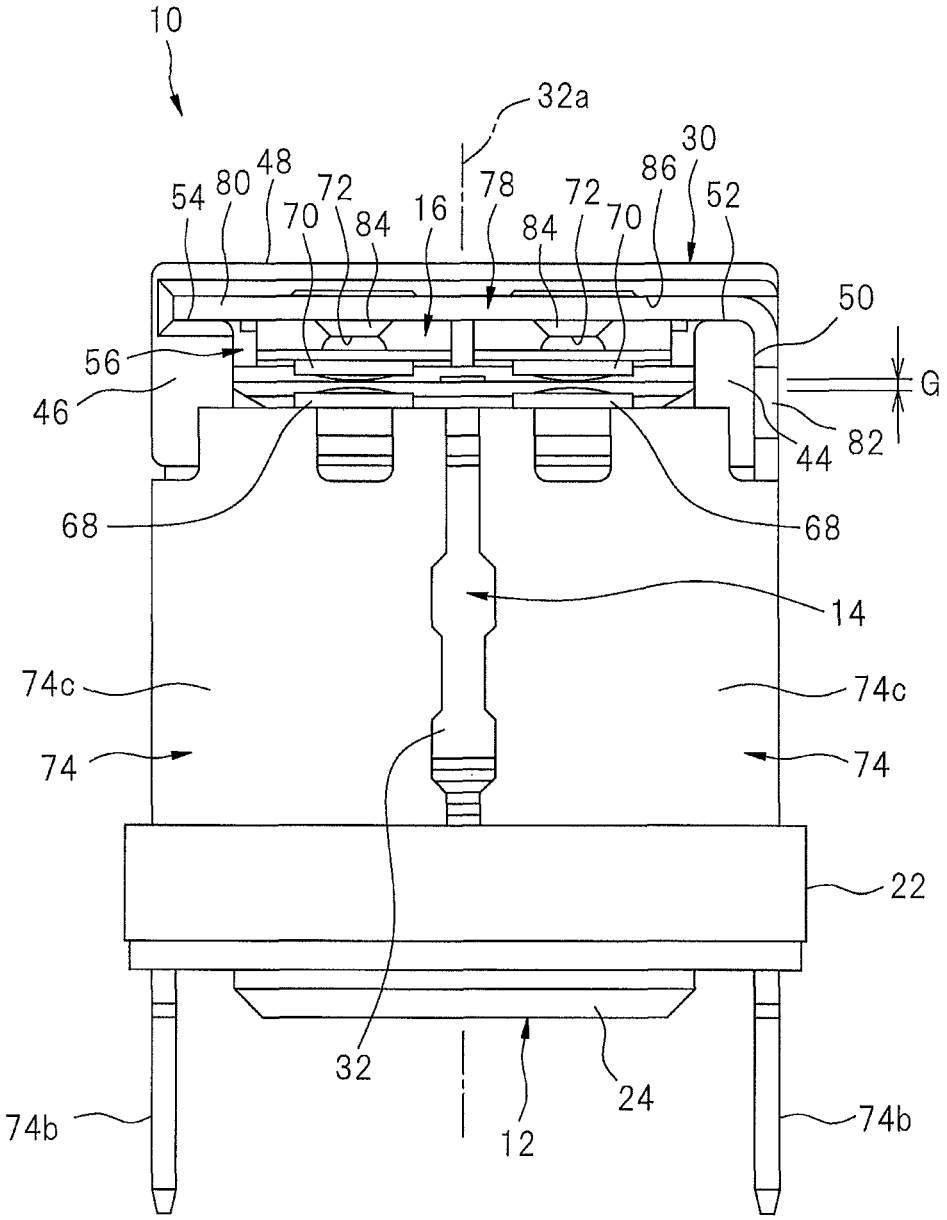
FIG. 4 is a front view depicting the electromagnetic relay of FIG. 2 in a different orientation.

Referring to the drawings, FIG. 1 depicts the major components of an electromagnetic relay 10 according to one embodiment, in an exploded manner. FIGS. 2 to 4 depict the electromagnetic relay 10, in an assembled state with a cover removed. The electromagnetic relay 10 includes a base 12, an electromagnet 14 installed on the base 12, a contact section 16 installed on the base 12 and operating to open or close to follow the actuation of the electromagnet 14, an armature 18 for transmitting the actuation of the electromagnet 14 to the contact section 16, and a cover 20 attached to the base 12 so as to enclose the electromagnet 14, the contact section 16 and the armature 18.

The base 12 includes a frame part 22 extending in a substantially rectangular shape as viewed from above, and a bottom part 24 closing the bottom end of the frame part 22. The base 12 is provided with an upwardly opening recess 26 defined by the frame part 22 and the bottom part 24, and the electromagnet 14 is fixedly received and supported in the recess 26. A plurality of support holes 28 are formed in the bottom part 24 of the base 12, for respectively supporting a plurality of coil terminals (described later) of the electromagnet 14 and a plurality of terminal members (described later) of the contact section 16. The base 12 including the frame part 22 and the bottom part 24 is formed as a unitary or one-piece structure by, e.g., injection molding from, e.g., an electrically insulating resin material.

The electromagnet 14 includes a bobbin 30, a coil 32 attached to the bobbin 30, an iron core 34 received in the bobbin 30, and a yoke 36 joined to the core 34 and extending outside the coil 32. As depicted in FIG. 4, the electromagnet 14 is mounted on the bottom part 24 of the base 12 with the center axis 32*a* of the coil 32 oriented in a vertical or upward-downward direction substantially perpendicular to the bottom part 24.

The bobbin 30 includes a hollow cylindrical barrel 38, a first flange 40 and a second flange 42, the flanges 40, 42 being provided at longitudinally opposite ends of the barrel 38. In the assembled state of the electromagnetic relay 10, the bobbin 30 is arranged in a manner such that the second flange 42 is received in the recess 26 of the base 12, the barrel 38 is disposed upright or extends in a vertical or upward-downward direction relative to the base 12, and the first flange 40 is located above the base 12 substantially parallel to the second flange 42.

The first and second flanges 40, 42 are disposed substantially parallel to the bottom part 24 of the base 12, and the barrel 38 is disposed substantially perpendicular to the bottom part 24. As depicted in FIG. 1, each of the first and second flanges 40, 42 is a substantially rectangular plate-like element extending circumferentially from the barrel 38, and in the aforementioned assembled state, a substantially rear-half portion of each flange 40, 42 extends in a backward direction further than the other portion thereof.

The first flange 40 of the bobbin 30 is provided with an upwardly protruding first sidewall 44 formed along the right side edge of the substantially rear-half portion of the flange 40, and an upwardly protruding second sidewall 46 is formed along the left side edge of the same rear-half portion. The first and second sidewalls 44, 46 are substantially rectangular plate-like elements, and extending substantially parallel to each other and perpendicular to the first flange 40. The top ends of the first and second sidewalls 44, 46 are located at substantially the same height above the bottom part 24 of the base 12.

A top wall 48 is formed on the top ends of the first and second sidewalls 44, 46 so as to extend between the sidewalls 44, 46. The top wall 48 is a substantially rectangular plate-like element and extending substantially parallel to the first flange 40. The upper surface of the first flange 40 and the lower surface of the top wall 48, which are opposed to each other, are substantially planar.

As depicted in FIGS. 1 and 4, the first sidewall 44 is formed so that the upper end portion thereof joined to the top wall 48 has a thickness (i.e., a dimension in a horizontal or rightward-leftward direction) greater than that of the lower portion thereof. The first sidewall 44 is provided on the outer surface of the thinner portion thereof (i.e., a surface away from the second sidewall 46) with a depression 50 recessed leftward from the right side edges of the top wall 48 and the substantially front-half portion of the first flange 40. Further, the first sidewall 44 is provided with a slit 52 formed at a position between the thinner portion and the top wall 48 so as to extend through the first sidewall 44 between the outer and inner surfaces thereof and open at the rear end thereof, the slit 52 extending substantially parallel to both of the first flange 40 and the top wall 48.

On the other hand, the second, left-side sidewall 46 has a substantially uniform thickness (i.e., a dimension in a horizontal or rightward-leftward direction) in its entirety. The second sidewall 46 is provided on the inner surface thereof (i.e., a surface facing the first sidewall 44) with a groove 54 formed at a position between the uniform thickness portion and the top wall 48 so as to open at the rear end and inner surface of the second sidewall 46, the groove 54 extending substantially parallel to both of the first flange 40 and the top wall 48. The slit 52 and the groove 54 have substantially the same length from the rear ends of the first and second sidewalls 44, 46, and are disposed at substantially the same height above the bottom part 24 of the base 12.

The first flange 40 is provided in the substantially rear-half portion thereof (i.e., a portion further extending backward from the barrel 38) with a contact accommodating portion 56 opening at front and rear ends, the contact accommodating portion 56 being defined by the first flange 40, the first and second sidewalls 44, 46, and the top wall 48. The contact accommodating portion 56 accommodates the contact section 16, in a manner as described later. The first and second sidewalls 44, 46 of the bobbin 30 constitute a backstop positioner as described later. The bobbin 30 including the barrel 38, the first flange 40, the second flange 42, the first sidewall 44, the second sidewall 46 and the top wall 48 is formed as a unitary or one-piece structure by, e.g., injection molding from, e.g., an electrically insulating resin material.

The coil 32 is formed by winding an electrically conductive wire of a desired length around the barrel 38 of the bobbin 30 so as to define a center axis 32*a*, and is fixedly retained between the first and second flanges 40, 42. The opposite distal ends (not depicted) of the conductive wire forming the coil 32 are respectively connected to a pair of coil terminals 58. Each coil terminal 58 includes at one end thereof an arm part 58*a* to which the conductive wire of the coil 32 is connected, and at the other end thereof a leg part 58*b* adapted to be connected to an exciting circuit (not depicted) for the electromagnet 14.

The coil terminal 58 is arranged in a manner such that the arm part 58*a* is disposed inside the recess 26 of the base 12 so as to extend along the bottom part 24 and the second flange 42 of the bobbin 30, and the leg part 58*b* penetrates through one support hole 28 (FIG. 1) formed at a position halfway between the front and rear edges of the bottom part 24 of the base 12 and protrudes downward from the base 12, as depicted in FIGS. 2 and 3. The coil terminal 58 may be fixed to the base 12 by press-fitting the leg part 58*b* into the support hole 28 previously formed in the base 12, or by insert-molding the base 12 with the leg part 58*b* located at the position of the support hole 28. The coil terminal 58 including the arm part 58*a* and the leg part 58*b* is formed as a unitary or one-piece structure by, e.g., punching and bending a metal plate having good electrical conductivity into a predetermined shape.

The core 34 includes a cylindrical shaft part 60 housed inside the barrel 38 of the bobbin 30, and a disc-shaped head part 62 extending radially outward from one axial end of the shaft part 60. The shaft part 60 is disposed inside the coil 32 so as to extend along the center axis 32*a* (FIG. 4). The head part 62 is exposed and placed along the upper surface of the first flange 40 of the bobbin 30. The other axial end 60*a* of the shaft part 60 slightly protrudes outward from the second flange 42 of the bobbin 30. The core 34 including the shaft part 60 and the head part 62 is formed as a unitary or one-piece structure from, e.g., a magnetic steel.

The yoke 36 includes a flat plate-like first part 64 joined to the axial end 60*a* of the shaft part 60 of the core 34, and a flat plate-like second part 66 extending in a direction substantially perpendicular to the first part 64 with a bent part interposed therebetween. The first part 64 is disposed along the lower surface of the second flange 42 of the bobbin 30 so as to extend in a frontward-rearward direction substantially perpendicular to the center axis 32*a* of the coil 32 (FIG. 4), and is fixed to the shaft part 60 of the core 34 by, e.g., swaging. The second part 66 is disposed in front of and spaced from the coil 32, and extends in a vertical or upward-downward direction substantially parallel to the center axis 32*a* of the coil 32 (FIG. 4). The upper end 66*a* of the second part 66 is located at the same height as the upper surface of the first flange 40 of the bobbin 30. The yoke 36 including the first and second parts 64, 66 is formed as a unitary or one-piece L-shaped plate-like structure from, e.g., a magnetic steel. The core 34 cooperates with the yoke 36 to form a magnetic path around the coil 32.

The contact section 16 includes a fixed contact 68, a movable contact 70 disposed opposite to the fixed contact 68 and capable of contacting and separating from the fixed contact 68, the movable contact 70 adapted to be actuated by the electromagnet 14, and a backstop 72 for stopping movement of the movable contact 70 in a direction separating from the fixed contact 68 and defining a predetermined contact gap G (FIG. 4) between the fixed contact 68 and the movable contact 70. The contact section 16 has a monostable-type normally-open (or make) contact configuration in which, when the electromagnet 14 is not energized, the movable contact 70 is separated from the fixed contact 68 with the contact gap G defined therebetween.

In the embodiment depicted in FIGS. 1 to 4, the contact section 16 includes a pair of fixed contacts 68, and a pair of movable contacts 70 disposed opposite respectively to the fixed contacts 68 and capable of individually contacting and separating from the fixed contacts 68. The fixed contacts 68 are electrically insulated from each other, and the movable contacts 70 are electrically connected to each other. A twin contact configuration as described above has the advantage that contact reliability of the fixed and movable contacts 68, 70 in a closed state is improved, or heat generation of the contact section 16 is suppressed. The backstop 72 acts on the pair of movable contacts 70, and defines the contact gap G evenly between respective movable contacts 70 and counterpart fixed contacts 68.

The electromagnetic relay 10 includes a pair of fixed terminal members 74, each of which is provided with the fixed contact 68. In the assembled state of the electromagnetic relay 10, the fixed terminal members 74 are disposed side-by-side with and horizontally spaced from each other on the base 12, and are electrically insulated from each other as well as from the coil 32 of the electromagnet 14. Each fixed terminal member 74 includes at one end thereof an arm part 74*a* carrying on the upper surface thereof the fixed contact 68, at the other end thereof a leg part 74*b* adapted to be connected to a load circuit (not depicted) to be opened or closed by the electromagnetic relay 10, and an intermediate part 74*c* extending between the arm part 74*a* and the leg part 74*b*. The intermediate part 74*c* of each fixed terminal member 74 extends in a vertical or upward-downward direction substantially parallel to the center axis 32*a* of the coil 32 (FIG. 4) at a predetermined position in the rear of the electromagnet 14.

The arm part 74*a* of each fixed terminal member 74 is disposed substantially parallel to the bottom part 24 of the base 12 at a position higher than the first flange 40 of the bobbin 30 of the electromagnet 14, and is accommodated in the contact accommodating portion 56 provided in the rear-half portion of the first flange 40 of the bobbin 30, as depicted in FIG. 2, by inserting the arm part 74*a* through the rear opening of the contact accommodating portion 56. In this state, the arm part 74*a* is supported on the upper surface of the first flange 40, and the fixed contact 68 carried on the upper surface of the arm part 74*a* is fixedly disposed at a predetermined position in the contact accommodating portion 56. The leg part 74*b* of each fixed terminal member 74 penetrates through one support hole 28 (FIG. 1) formed at a rear end position of the bottom part 24 of the base 12 and protrudes downward from the base 12, as depicted in FIGS. 2 and 3.

Each fixed terminal member 74 may be fixed to the base 12 by press-fitting the leg part 74*b* into the support hole 28 previously formed in the base 12, or by insert-molding the base 12 with the leg part 74*b* located at the position of the support hole 28. The fixed terminal member 74 including the arm part 74*a*, the leg part 74*b* and the intermediate part 74*c* is formed as a unitary or one-piece structure by, e.g., punching and bending a metal plate having good electrical conductivity into a predetermined shape. The fixed contact 68 is formed from a suitable contact material, and is fixed to the upper surface of the arm part 74*a* of the fixed terminal member 74 by, e.g., swaging.

In the swaging structure, the swaged portion of the fixed contact 68 may protrude slightly from the lower surface of the arm part 74*a*. In this case, for example, the swaged portion may be received in a slightly recessed portion formed correspondingly to the swaged portion on the upper surface of the first flange 40. According to this structure, it is possible to prevent the swaged portion from causing a gap defined between the lower surface of the arm part 74*a* and the upper surface of the first flange 40, and thereby to stably support the arm part 74*a* on the first flange 40.

The electromagnetic relay 10 includes a single movable terminal member 76 provided with the pair of movable contacts 70. In the assembled state of the electromagnetic relay 10, the movable terminal member 76 is disposed on the base 12 and electrically insulated from the coil 32 of the electromagnet 14. The movable terminal member 76 includes at one end thereof a pair of spring arm parts 76 respectively carrying on the lower surfaces thereof the movable contacts 70, at the other end thereof a pair of leg parts 76*b* adapted to be connected to a load circuit (not depicted) to be opened or closed by the electromagnetic relay 10, and an intermediate part extending between the spring arm parts 76*a* and the leg parts 76*b*.

The intermediate part of the movable terminal member 76 includes a horizontal part 76*c* adjacent to the pair of spring arm parts 76*a*, a vertical part 76*d* adjacent to the pair of leg parts 76*b*, and a pair of L-shaped bent parts 76*e* extending between the horizontal part 76*c* and the vertical part 76*d*. The horizontal part 76*c* is fixed to the upper surface of the armature 18 by, e.g., swaging, and is disposed along the upper surface of the first flange 40 of the bobbin 30 of the electromagnet 14 together with the armature 18. The vertical part 76*d* is fixed to the front surface of the second part 66 of the yoke 36 of the electromagnet 14 by, e.g., swaging, and extends in a vertical or upward-downward direction substantially parallel to the center axis 32*a* of the coil 32 (FIG. 4) at a predetermined position in front of the electromagnet 14.

Each of the bent parts 76*e* has elasticity and allows the spring arm parts 76*a* and the horizontal part 76*c* to elastically shift in a vertical or upward-downward direction in a swinging manner with respect to the vertical part 76*d* and the leg parts 76*b* fixedly disposed on the base 12.

The spring arm parts 76*a* of the movable terminal member 76, each having elasticity, extend rearward from the horizontal part 76*c* as bifurcated right and left parts. As depicted in FIG. 2, the free end regions 76*f* of the spring arm parts 76*a* are located at a position higher than the arm parts 74*a* of the fixed terminal members 74, and are accommodated in the contact accommodating portion 56 provided in the rear-half portion of the first flange 40 of the bobbin 30, by inserting the free end regions 76*f* through the front opening of the contact accommodating portion 56. In this state, the free end regions 76*f* of the pair of spring arm parts 76*a* are shiftable in a vertical or upward-downward direction in the contact accommodating portion 56, and the movable contacts 70 carried respectively on the lower surfaces of the spring arm parts 76*a* are disposed opposite to the counterpart fixed contacts 68 carried on the upper surfaces of the arm parts 74*a* of the pair of fixed terminal members 74 and are movable in a direction contacting and separating from the counterpart fixed contacts 68. The pair of leg parts 76*b* of the movable terminal member 76 penetrate through a pair of support holes 28 (FIG. 1) formed at front end positions of the bottom part 24 of the base 12 and protrude downward from the base 12, as depicted in FIGS. 2 and 3.

The movable terminal member 76 may be fixed to the base 12 by press-fitting the leg parts 76*b* into the support holes 28 previously formed in the base 12, or by insert-molding the base 12 with the leg parts 76*b* located at the positions of the support holes 28. The movable terminal member 76 including the pair of spring arm parts 76*a*, the pair of leg parts 76*b*, the horizontal part 76*c*, the vertical part 76*d* and the pair of bent parts 76*e* is formed as a unitary or one-piece structure by, e.g., punching and bending a metal plate having good electrical conductivity into a predetermined shape. Alternatively, the movable terminal member 76 may have a configuration wherein the pair of spring arm parts 76*a*, the horizontal part 76*c*, the vertical part 76*d* and the pair of bent parts 76*e* are formed as a unitary structure from a material having spring properties, such as phosphor bronze used for making a spring, and the pair of leg parts 76*b* formed as separate components from a material having good electrical conductivity are fixed to the unitary structure. Each movable contact 70 is formed from a suitable contact material, and is fixed to the lower surface of each spring arm part 76*a* of the movable terminal member 76 by, e.g., swaging.

The armature 18 is a flat plate-like, power transmitting member interposed between the electromagnet 14 and the movable terminal member 76. The armature 18 is fixed to the lower surface of the horizontal part 76*c* of the movable terminal member 76, and is disposed in its entirety along the upper surface of the first flange 40 of the bobbin 30. As depicted in FIGS. 2 and 3, the armature 18 is supported at the front end 18*a* thereof on the upper end 66*a* of the second part 66 of the yoke 36 with a part of the lower surface of the armature 18 at the front end 18*a* contacting the upper end 66*a*. The rear part 18*b* of the armature 18 is disposed opposite to the head part 62 of the core 34. The armature 18 is movable in a rocking manner over a predetermined angular range, about a fulcrum defined by the front end 18*a* supported on the second part 66 of the yoke 36, in a direction such that the rear part 18*b* comes into contact with or is separated from the head part 62 of the core 34. The armature 18 is formed by, e.g., punching a magnetic steel into a predetermined shape.

The movable terminal member 76 is configured to bias the armature 18 in an upward direction away from the head part 62 of the core 36 by an elastic restoring force (hereinafter referred to as a spring force) generated in the bent parts 76*e* acting as an elastic hinge between the horizontal part 76*c* fixed to the armature 18 and the vertical part 76*d* fixed to the yoke 36. When the electromagnet 14 is not energized, the armature 18 is disposed at a position away from the head part 62 of the core 36 under the spring force, and thus the pair of movable contacts 70 are separated from the counterpart fixed contacts 68. When the electromagnet 14 is energized by the excitation of the coil 32, the armature 18 cooperates with the core 34 and the yoke 36 to form a magnetic path, and a magnetic attractive force is generated to attract the armature 18 toward the head part 62 of the core 34.

When the attractive force of the electromagnet 14 exceeds the spring force of the movable terminal member 76, the armature 18 moves toward the head part 62 of the core 34, and the movable contacts 70 come into contact with the counterpart fixed contacts 68 just before the armature 18 is held on the head part 62 by the attractive force. In the state where the armature 18 is attractively held on the head part 62, each spring arm part 76*a* of the movable terminal member 76 extending rearward from the armature 18 elastically bends between the mutually abutting armature 18 and head part 62 and the mutually abutting movable contact 70 and fixed contact 68, and thus the movable contact 70 is maintained in contact with the counterpart fixed contact 68 under a predetermined contact pressure due to the elastic restoring force of the spring arm part 76*a*.

The electromagnetic relay 10 includes a stop member 78 provided with the backstop 72. The stop member 78 includes a major part 80 having a substantially rectangular flat plate shape, and an auxiliary part 82 extending from one side edge of the major part 80 in a direction substantially perpendicular to the major part 80. The backstop 72 is formed on one surface of the major part 80 of the stop member 78 on the same side as the auxiliary part 82 extends. The stop member 78 is fixedly attached to the first and second sidewalls 44, 46 formed upright on the first flange 40 of the bobbin 30 of the electromagnet 14. More specifically, as depicted in FIGS. 2 and 4, the stop member 78 is fixed to the first and second sidewalls 44, 46 by press-fitting the right end portion of the major part 80 adjacent to the auxiliary part 82 into the slit 52 formed in the first sidewall 44 and the left end portion of the major part 80 farthest from the auxiliary part 82 into the groove 54 formed in the second sidewall 46.

In the above attached state, the major part 80 of the stop member 78 is accommodated in the contact accommodating portion 56 provided on the first flange 40, and is fixedly disposed between the top wall 48 extending between the first and second sidewalls 44, 46 and the free end regions 76*f* of the pair of spring arm parts 76*a* of the movable terminal member 76 accommodated in the contact accommodating portion 56. The upper surface of the major part 80 of the stop member 78 abuts on the lower surface of the top wall 48. Further, in the above attached state, the auxiliary part 82 of the stop member 78 is fixedly received in the depression 50 formed on the outer surface of the first sidewall 44. The first and second sidewalls 44, 46 of the bobbin 30, which allow the stop member 78 to be attached at a predetermined position (i.e., the positions of the slit 52 and the groove 54), constitute a backstop positioner for setting the backstop 72 at a position for defining a predetermined contact gap G between the fixed contact 68 and the movable contact 70 within the contact accommodating portion 56.

In the aforementioned attached state, the backstop 72 is set by the first and second sidewalls 44, 46 of the bobbin 30 at a position where the backstop 72 is opposed, in a contactable and separable relationship, to the upper surfaces of the free end regions 76*f* of the pair of spring arm parts 76*a* of the movable terminal member 76, the upper surfaces being the back sides of the movable contacts 70. In the case where the movable contact 70 is fixed to the spring arm part 76*a* by swaging, the backstop 72 is opposed, in a contactable and separable relationship, to the swaged portions of the movable contacts 70 protruding from the upper surfaces of the spring arm parts 76*a*.

In the embodiment depicted in FIGS. 1 to 4, a pair of protrusions 84 are provided on the lower surface of the major part 80 of the stop member 78 at positions aligned in a vertical or upward-downward direction with the pair of movable contacts 70, and the bottom end faces of the protrusions 84 constitute the backstop 72 (FIG. 4). The stop member 78 including the backstop 72 (i.e., the protrusions 84), the major part 80 and the auxiliary part 82 is formed as a unitary or one-piece structure by punching and bending a suitable metal plate into a predetermined shape, or alternatively, by injection molding from a suitable resin material. Alternatively, the stop member 78 may have a configuration wherein the protrusions 84 formed as separate components are fixed to the previously formed major part 80 of the stop member 78 by, e.g., swaging or welding.

In the case wherein the protrusions 84 are fixed by swaging, the swaged portions of the protrusions 84 may protrude slightly from the upper surface of the major part 80. In this case, for example, the swaged portions may be received in slightly recessed portions formed correspondingly to the swaged portions on the lower surface of the top wall 48. According to this structure, it is possible to prevent the swaged portion from causing a gap defined between the upper surface of the major part 80 and the lower surface of the top wall 48, and thereby to stably support the major part 80 on the top wall 48. The materials of the stop member 78 and the protrusions 84 are not particularly limited, although it is preferable to use materials having rigidity enabling the backstop 72 to maintain a predetermined contact gap G (FIG. 4) during the passage of time.

When the electromagnet 14 is not energized, the free end regions 76*f* of the pair of spring arm parts 76*a* of the movable terminal member 76, accommodated in the contact accommodating portion 56, are abutted on the backstop 72 under the spring force exerted by the bent parts 76*e* of the movable terminal member 76. In this state, the backstop 72 acts to stop upward movement of each spring arm part 76*a* caused by the spring force generated by the movable terminal member 76, in other words, movement of each movable contact 70 carried on the spring arm part 76*a* in a direction separating from the counterpart fixed contact 68, and thereby defines a predetermined contact gap G (FIG. 4) between the mutually opposed fixed and movable contacts 68, 70.

In the state where upward movement of the movable contact 70 relative to the fixed contact 68 is stopped by the backstop 72, each spring arm part 76*a* of the movable terminal member 76 is elastically bent while the free end region 76*f* is abutted on the backstop 72 by the spring force of the bent part 76*e*, and the free end region 76*f* is pressed onto the backstop 72 by the elastic restoring force of the spring arm part 76*a*. As a result, the contact gap G is stably maintained at a predetermined size depending on the position of the backstop 72 relative to the fixed contact 68.

In the electromagnetic relay 10, in the state where movement of the movable contact 70 is stopped by the backstop 72, different-sized contact gaps G can be defined between the fixed contact 68 and the movable contact 70, depending on the position of the backstop 72 set by the backstop positioner. For example, the electromagnetic relay 10 may have a configuration wherein various types of stop members 78 differing in the height of the backstop 72 (i.e., the dimension of the protrusion 84) from the lower surface of the major part 80 are provided in advance, and in the manufacturing process of the electromagnetic relay 10, one stop member 78 suitably selected from the various stop members 78 is fixed to the first and second sidewalls 44, 46 of the bobbin 30 of the electromagnet 14 in a manner as described above. According to this configuration, the position of the backstop 72 can be selectively changed, and thereby the desired contact gap G can be defined depending on the height of the backstop 72 from the lower surface of the major part 80. Alternatively, instead of using the protrusions 84, the electromagnetic relay 10 may have a configuration wherein various types of stop members 78 differing in the thickness of the major part 80 are provided in advance, and one stop member 78 with the major part 80 of the desired thickness is suitably selected from the various stop members 78 for use.

In either configuration, it is preferred to previously choose the dimensions, shapes, materials, etc., of the movable terminal member 76 and the stop member 78 so as to ensure a configuration wherein, even when the position of the backstop 72 is changed, the free end region 76*f* of each spring arm part 76*a* of the movable terminal member 76 is pressed onto the backstop 72 by the elastic force of the spring arm part 76*a* as described above and thereby the contact gap G is reliably defined so as to correspond to the position of the backstop 72. In either configuration, the first and second sidewalls 44, 46 (especially the slit 52 and the groove 54) of the bobbin 30 function as the backstop positioner capable of setting the backstop 72 at least respectively at a first position for defining the contact gap G having a first size and a second position for defining the contact gap G having a second size different from the first size.

Alternatively, the electromagnetic relay 10 may have a configuration wherein the stop member 78 is optionally not attached to the bobbin 30 in the manufacturing process of the electromagnetic relay 10, and the lower surface of the top wall 48 of the bobbin 30 is used as a second backstop 86 (FIG. 4). More specifically, the configuration of the electromagnetic relay 10 may be modified as needed by omitting the stop member 78 and thereby changing the first backstop 72 to the second backstop 86, so that the size of the contact gap G is changed accordingly. The second backstop 86 constituted by the lower surface of the top wall 48 is set at a position where the second backstop 86 is opposed, in a contactable and separable relationship, to the upper surfaces of the free end regions 76*f* of the pair of spring arm parts 76*a* of the movable terminal member 76, the upper surfaces being the back sides of the movable contacts 70.

In this configuration, it is preferred to previously choose the dimensions, shapes, materials, etc., of the movable terminal member 76 so as to ensure a configuration wherein, even when the first backstop 72 is changed to the second backstop 86, the free end region 76*f* of each spring arm part 76*a* of the movable terminal member 76 is pressed onto the second backstop 86 by the elastic force of the spring arm part 76*a* as described above and thereby the contact gap G is reliably defined so as to correspond to the position of the second backstop 86. In this configuration, the first and second sidewalls 44, 46 of the bobbin 30 serve to place the top wall 48 fixedly at the predetermined upper end positions thereof, and thus function as the backstop positioner capable of setting not only the first backstop 72 at a first position for defining the contact gap G having a first size but also the second backstop 86 at a second position for defining the contact gap G having a second size different from the first size.

The size of the contact gap G defined depending on the position of the backstop 72 (86) may be determined so as to be appropriate for an electric voltage or current applied to a load circuit (not depicted) to be opened or closed by the electromagnetic relay 10, and, e.g., to be capable of suppressing an arc discharge that may occur between mutually opposing contacts when the circuit is opened. For example, if a contact gap G1 is determined for a configuration wherein the electromagnetic relay 10 is operable to open and close a voltage V1, a contact gap G2 larger than the contact gap G1 is generally determined for a configuration wherein the electromagnetic relay 10 is operable to open and close a voltage V2 larger than the voltage V1. In the electromagnetic relay 10, in order to ensure either one of the contact gaps G1 and G2, the dimensions, shapes, materials, etc., of the movable terminal member 76 and the stop member 78 are selected.

The aforementioned configuration wherein the position of the backstop 72 (86) (i.e., the size of the contact gap G) is changed by replacing or omitting the stop member 78 can be achieved by selecting a desired stop member 78 among the various-type stop members 78 or choosing whether the stop member 78 is attached or not, in the manufacturing process of the electromagnetic relay 10. Therefore, according to the electromagnetic relay 10, only by way of design change concerning the position of the backstop 72 (86), i.e., concerning the type or provision of the stop member 78, it is possible to manufacture the electromagnetic relay 10 of a type ensuring a contact gap G defined appropriately for an electric voltage or current applied to a load circuit (not depicted) to be opened or closed by the electromagnetic relay 10. In particular, since the electromagnetic relay 10 is configured so that predetermined different-sized contact gaps G are defined depending on the position of the backstop 72 (86) provided for stopping movement of the movable contact 70 in a direction separating from the fixed contact 68, the movable contact 70 is stably held by the backstop 72 (86) at a predetermined position relative to the fixed contact 68 during a contact open state, and thus the contact gap G is stably maintained at a predetermined size. Accordingly, in the electromagnetic relay 10, it is possible to address changes in an electric voltage or current applied to a load circuit while ensuring a stable opening and closing operation of a contact, by way of minimum design change.

In the configuration of the above embodiment wherein the stop member 78 is press-fitted to the slit 52 and groove 54 formed in the first and second sidewalls 44, 46 of the bobbin 30, it is also possible to enlarge the contact gap G by removing the stop member 78 as needed from the first and second sidewalls 44, 46 in the already manufactured electromagnetic relay 10, instead of making design change in the manufacturing process of the electromagnetic relay 10. In this configuration, the electromagnetic relay 10 as a finished product is provided with both the first backstop 72 set at the first position for defining the contact gap G having the first size and the second backstop 86 set at the second position for defining the contact gap G having the second size larger than the first size. If removal of the stop member 78 does not need to be considered, the stop member 78 may be permanently fixed to the first and second sidewalls 44, 46 (i.e., the backstop positioner) by, e.g., bonding.

The cover 20 of the electromagnetic relay 10 includes a surrounding wall part 88 having a substantially rectangular shape as viewed from above, and a top part 90 closing the top end of the surrounding wall part 88. The cover 20 is provided with a downwardly opening space 92 defined by the surrounding wall part 88 and the top part 90, and the electromagnet 14, the contact section 16 and the armature 18 are accommodated in the space 92. The cover 20 is secured at the lower end of the surrounding wall part 88 to the frame part 22 of the base 12 by, e.g., bonding. The cover 20 including the surrounding wall part 88 and the top part 90 is formed as a unitary or one-piece structure by, e.g., injection molding from, e.g., an electrically insulating resin material.

Figure 5:
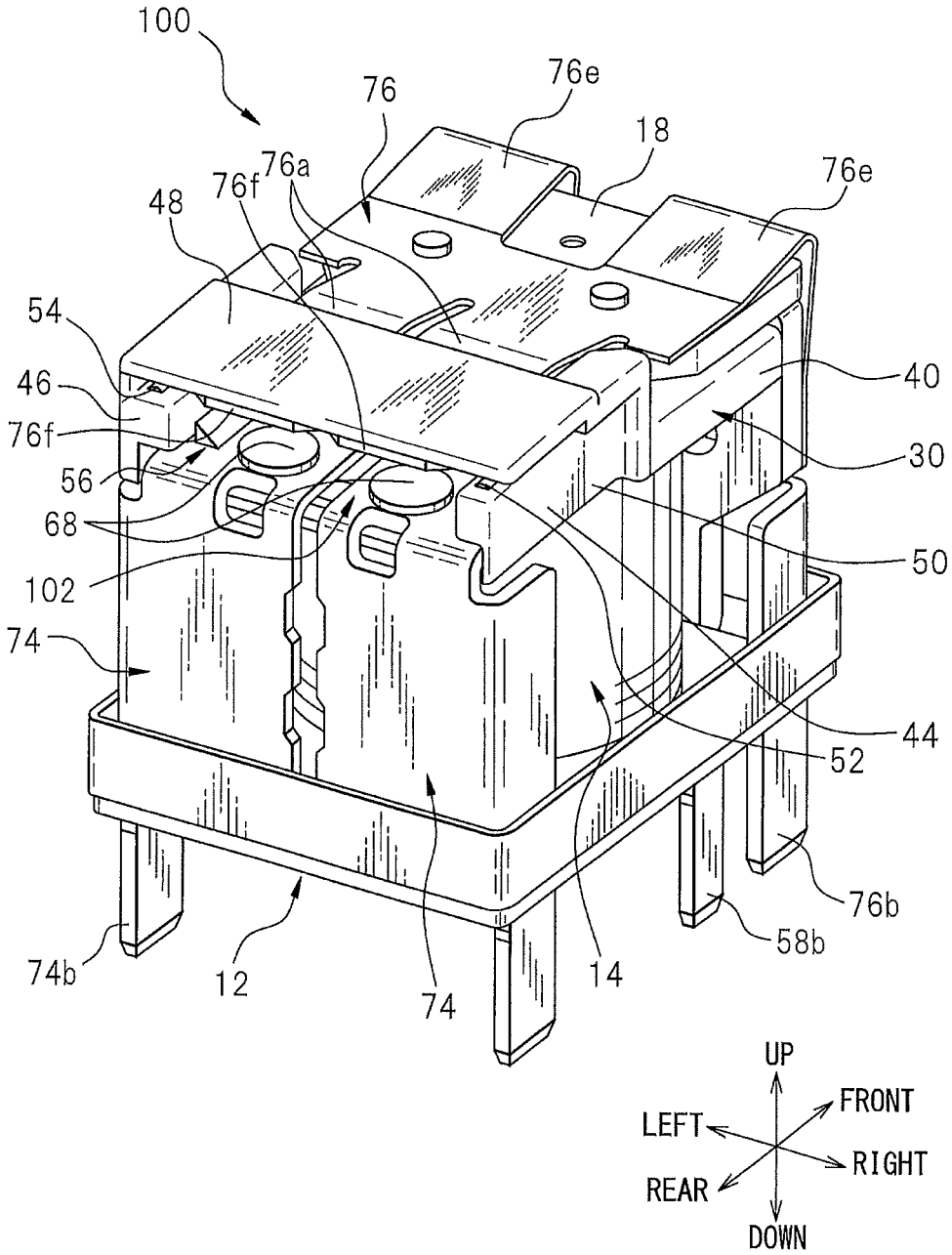
FIG. 5 is a perspective view corresponding to FIG. 2, but depicting an electromagnetic relay according to another embodiment.
Figure 6:
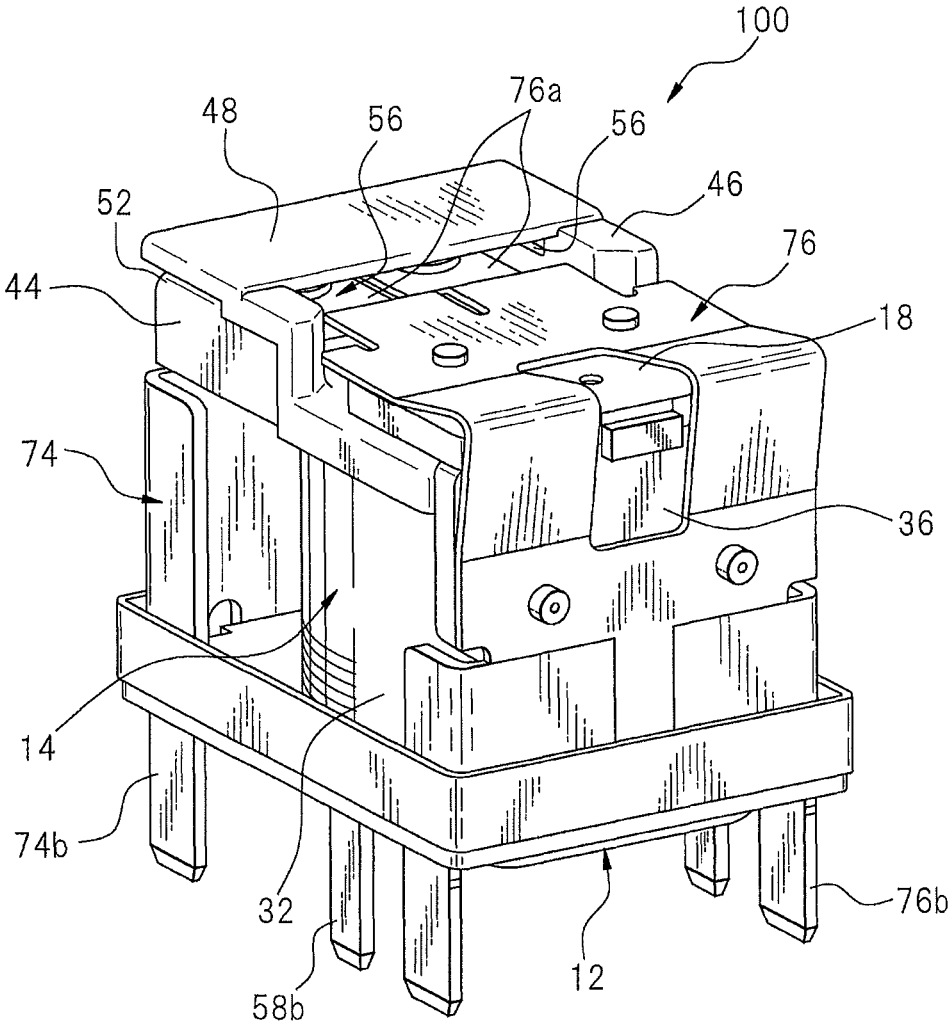
FIG. 6 is a perspective view depicting the electromagnetic relay of FIG. 5 in a different orientation.
Figure 7:
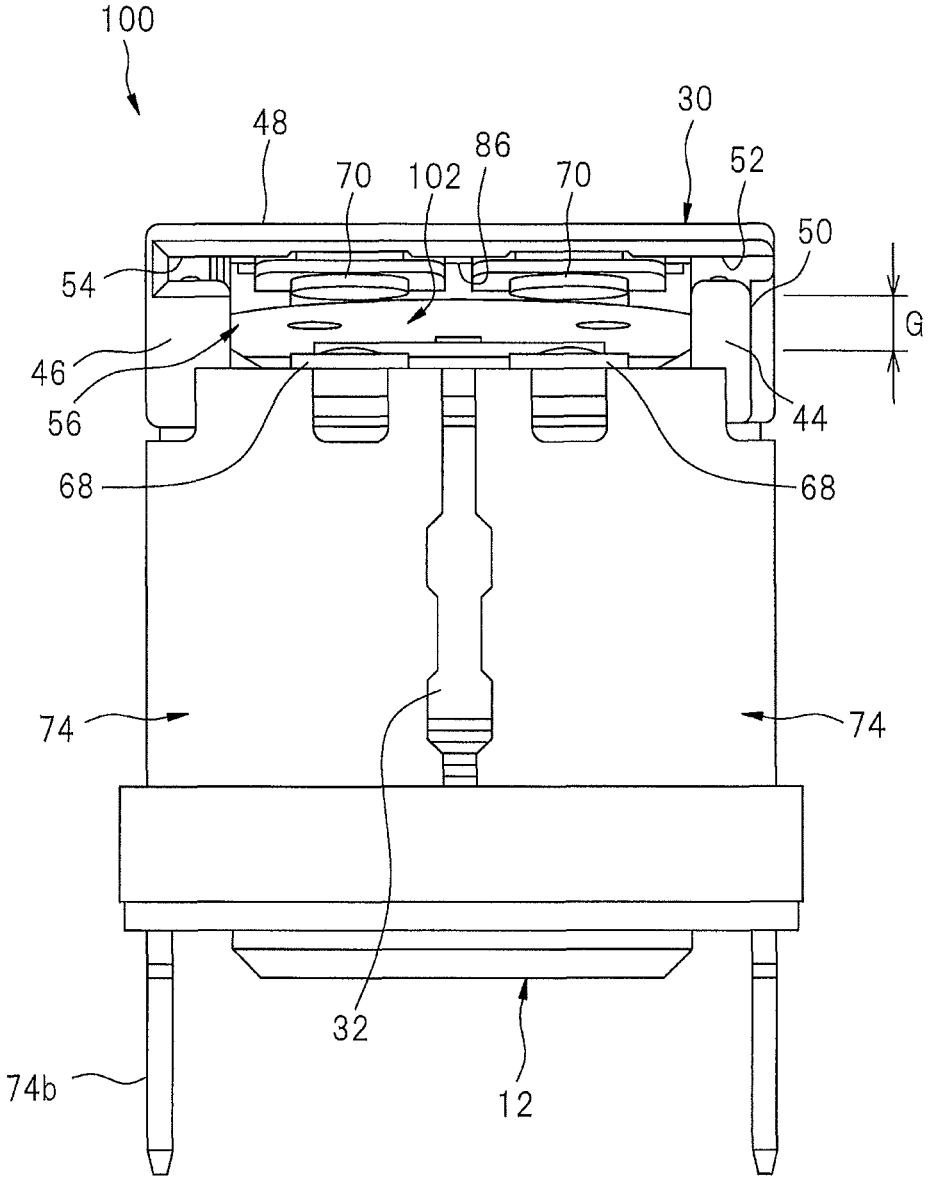
FIG. 7 is a front view depicting the electromagnetic relay of FIG. 5 in a different orientation.

FIGS. 5 to 7 depict an electromagnetic relay 100 according to another embodiment, in an assembled state with a cover removed. The electromagnetic relay 100 has a configuration substantially identical to that of the electromagnetic relay 10, except that a stop member 78 is not included. Therefore, the corresponding components are denoted by the same reference numerals, and detailed descriptions thereof will not be repeated.

The electromagnetic relay 100 includes a base 12, an electromagnet 14, a contact section 102 and an armature 18, as depicted in FIGS. 5 to 7, and also includes a cover 20 as depicted in FIG. 1. The contact section 102 includes a pair of fixed contacts 68, a pair of movable contacts 70, and a backstop 86 for stopping movement of the movable contacts 70 in a direction separating from the fixed contacts 68 and defining a predetermined contact gap G (FIG. 7) between each fixed contact 68 and the counterpart movable contact 70. The backstop 86 is constituted by the lower surface of a top wall 48 formed in a first flange 40 of a bobbin 30 of the electromagnet 14. The backstop 86 is set at a position where the backstop 86 is opposed, in a contactable and separable relationship, to upper surfaces of free end regions **76*f* of a pair of spring arm parts 76*a* of a movable terminal member 76, the upper surfaces being the back sides of the movable contacts 70. First and second sidewalls 44, 46 of the bobbin 30, on which the top wall 48 is formed at a predetermined position (i.e., an upper end), constitute a backstop positioner for setting the backstop 86 at a position for defining a predetermined contact gap G between the fixed contact 68 and the movable contact 70 within a contact accommodating portion 56**.

In the electromagnetic relay 100, when the electromagnet 14 is not energized, the free end regions **76*f* of the pair of spring arm parts 76*a* of the movable terminal member 76, accommodated in the contact accommodating portion 56, are abutted on the backstop 86 constituted by the lower surface of the top wall 48, under the spring force exerted by bent parts 76*e* of the movable terminal member 76. In this state, the backstop 86 acts to stop upward movement of each spring arm part 76*a* caused by the spring force generated by the movable terminal member 76, in other words, movement of each movable contact 70 carried on the spring arm part 76*a* in a direction separating from the counterpart fixed contact 68, and thereby defines a predetermined contact gap G (FIG. 7) between the mutually opposed fixed and movable contacts 68, 70. In the state wherein upward movement of the movable contact 70 relative to the fixed contact 68 is stopped by the backstop 86, each spring arm part 76*a* of the movable terminal member 76 is elastically bent while the free end region 76*f* is abutted on the backstop 86 by the spring force of the bent part 76*e*, and the free end region 76*f* is pressed onto the backstop 86 by the elastic restoring force of the spring arm part 76*a*. As a result, the contact gap G is stably maintained at a predetermined size depending on the position of the backstop 86 relative to the fixed contact 68**.

In the electromagnetic relay 100, in the state where movement of the movable contact 70 is stopped by the backstop 86, different-sized contact gaps G can be defined between the fixed contact 68 and the movable contact 70, depending on the position of the backstop 86 set by the backstop positioner, in a manner analogous to the configuration of the aforementioned electromagnetic relay 10 wherein the different-sized contact gaps G are defined depending on the position of the backstop 72. For example, the electromagnetic relay 100 may have a configuration wherein a protrusion (not depicted) similar to the aforementioned protrusion 84 of the stop member 78 is formed on the lower surface of the top wall 48 and the bottom end face of the protrusion constitutes a backstop 86 set at a position different from that of the backstop 86 constituted by the lower surface of the top wall 48. The protrusion constituting the backstop 86 may be provided by forming a protrusion integrally with the top wall 48 during a molding process of the bobbin 30 or bonding a separate protrusion to the previously molded top wall 48 in a subsequent step. In the configuration wherein the protrusion having a suitably selected size is formed on the lower surface of the top wall 48, the position of the backstop 86 can be selectively changed, and thereby the desired contact gap G can be defined depending on the height of the backstop 86 from the lower surface of the top wall 48.

Alternatively, the electromagnetic relay 100 may have a configuration wherein the top wall 48 having the backstop 86 is provided as a member separate from the first and second sidewalls 44, 46 formed in the first flange 40 of the bobbin 30. In this configuration, various types of top walls 48 differing in the size of the protrusion are provided in advance, and in the manufacturing process of the electromagnetic relay 100, one top wall 48 suitably selected from the various top walls 48 is fixed to the upper ends of the first and second sidewalls 44, 46, so that the desired contact gap G can be defined depending on the position of the backstop 86, as in the aforementioned configuration regarding the selection of the stop member 78 in the electromagnetic relay 10.

In either configuration, it is preferred to previously choose the dimensions, shapes, materials, etc., of the movable terminal member 76 and the top wall 48 so as to ensure a configuration wherein, even when the position of the backstop 86 is changed, the free end region **76*f* of each spring arm part 76*a* of the movable terminal member 76 is pressed onto the backstop 86 by the elastic force of the spring arm part 76*a* as described above and thereby the contact gap G is reliably defined so as to correspond to the position of the backstop 86. In either configuration, the first and second sidewalls 44, 46 (especially the upper ends thereof) of the bobbin 30 function as the backstop positioner capable of setting the backstop 86** at least respectively at a first position for defining the contact gap G having a first size and a second position for defining the contact gap G having a second size different from the first size.

Alternatively, the electromagnetic relay 100 may have a configuration wherein, in the manufacturing process of the electromagnetic relay 100, a stop member 78 as a component of the aforementioned electromagnetic relay 10 is fixed by a press-fitting to a slit 52 and a groove 54 previously formed in the first and second sidewalls 44, 46 of the bobbin 30, and the bottom end face of a protrusion 84 provided on the stop member 78 is used as a second backstop 72 (FIG. 4). More specifically, the configuration of the electromagnetic relay 100 may be modified as needed by attaching the stop member 78 and thereby changing the first backstop 86 to the second backstop 72, so that the size of the contact gap G is changed accordingly. The second backstop 72 provided on the lower surface of the stop member 78 is set at a position where the second backstop 72 is opposed, in a contactable and separable relationship, to the upper surfaces of the free end regions **76*f* of the pair of spring arm parts 76*a* of the movable terminal member 76, the upper surfaces being the back sides of the movable contacts 70**.

In this configuration, even when the first backstop 86 is changed to the second backstop 72, the free end region **76*f* of each spring arm part 76*a* of the movable terminal member 76 is pressed onto the second backstop 72 by the elastic force of the spring arm part 76*a* and thereby the contact gap G is reliably defined so as to correspond to the position of the second backstop 72. In this configuration, the first and second sidewalls 44, 46 of the bobbin 30, provided with the slit 52 and the groove 54 respectively, function as a backstop positioner capable of setting not only the first backstop 86 at a first position for defining the contact gap G having a first size, but also the second backstop 72** at a second position for defining the contact gap G having a second size different from the first size.

The size of the contact gap G defined depending on the position of the backstop 86 (72) may be determined so as to be appropriate for an electric voltage or current applied to a load circuit (not depicted) to be opened or closed by the electromagnetic relay 100, and, e.g., to be capable of suppressing an arc discharge that may occur between mutually opposing contacts when the circuit is opened. For example, if a contact gap G1 is determined for a configuration wherein the electromagnetic relay 100 is operable to open and close a voltage V1, a contact gap G2 larger than the contact gap G1 is generally determined for a configuration wherein the electromagnetic relay 10 is operable to open and close a voltage V2 larger than the voltage V1. In the electromagnetic relay 100, in order to ensure either one of the contact gaps G1 and G2, the dimensions, shapes, materials, etc., of the movable terminal member 76 and the top wall 48 are selected.

The aforementioned configuration wherein the position of the backstop 86 (72) (i.e., the size of the contact gap G) is changed by modifying the shape of the top wall 48 or attaching the stop member 78 can be achieved by selecting a desired top wall 48 among the various-shape top walls 48 or choosing whether the stop member 78 is attached or not, in the manufacturing process of the electromagnetic relay 100. Therefore, according to the electromagnetic relay 100, only by way of design change concerning the position of the backstop 86 (72), i.e., concerning the shape of the top wall 48 or the provision of the stop member 78, it is possible to manufacture the electromagnetic relay 100 of a type ensuring a contact gap G defined appropriately for an electric voltage or current applied to a load circuit (not depicted) to be opened or closed by the electromagnetic relay 100. In particular, since the electromagnetic relay 100 is configured so that predetermined different-sized contact gaps G are defined depending on the position of the backstop 86 (72) provided for stopping movement of the movable contact 70 in a direction separating from the fixed contact 68, the movable contact 70 is stably held by the backstop 86 (72) at a predetermined position relative to the fixed contact 68 during a contact open state, and thus the contact gap G is stably maintained at a predetermined size. Accordingly, in the electromagnetic relay 100, it is possible to address changes in an electric voltage or current applied to a load circuit while ensuring a stable opening and closing operation of a contact, by way of minimum design change.

Figure 8:
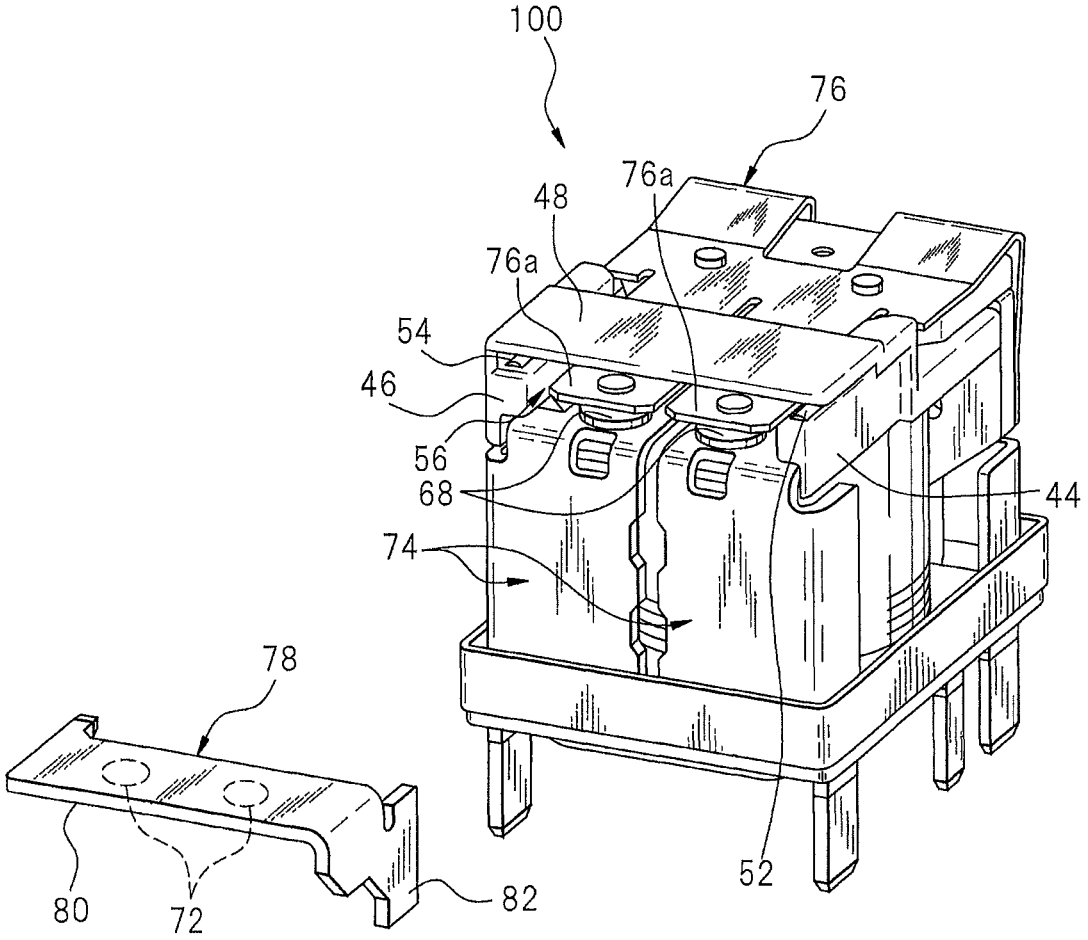
FIG. 8 is a perspective view illustrating one example of a process for changing a contact gap in the electromagnetic relay of FIG. 5.
Figure 9:
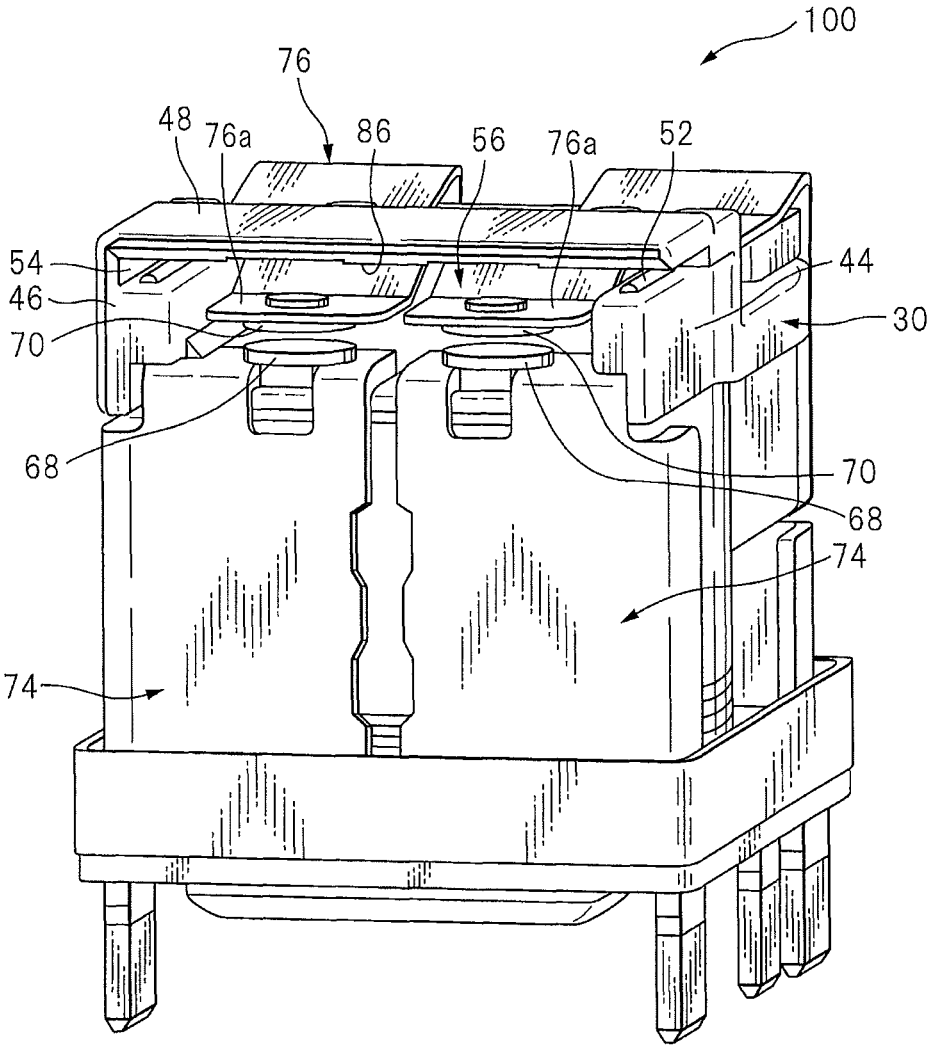
FIG. 9 is a perspective view depicting the electromagnetic relay of FIG. 8 in a different orientation.

In the configuration of the electromagnetic relay 100 wherein the first backstop 86 is changed to the second backstop 72 by press-fitting the stop member 78 to the slit 52 and groove 54 formed in the first and second sidewalls 44, 46 of the bobbin 30, it is also possible to attach the stop member 78 as needed to the first and second sidewalls 44, 46 in the already manufactured electromagnetic relay 100, instead of making design change in the manufacturing process of the electromagnetic relay 100. In this configuration, as depicted in FIGS. 8 and 9, the stop member 78 can be attached to the first and second sidewalls 44, 46 by pushing downward the pair of spring arm parts 76*a* of the movable terminal member 76 pressed on the backstop 86 of the top wall 48 by, e.g., hand work, so as to forcibly separate the spring arm parts 76*a* from the backstop 86, and inserting the major part 80 of the stop member 78 into a gap created between the spring arm parts 76*a* and the backstop 86 within the contact accommodating portion 56.

As described above, the electromagnetic relays 10 and 100 can be manufactured as two different types having different contact gaps G (G1 and G2) defined appropriately for an electric current or voltage of a load circuit, by selecting whether the stop member 78 is attached or not in the manufacturing process. For example, the electromagnetic relay 10 can be manufactured as one type of electromagnetic relay for automotive use capable of opening and closing a load circuit equipped with a 12V DC power supply, while the electromagnetic relay 100 can be manufactured as another type of electromagnetic relay for automotive use capable of opening and closing a load circuit equipped with a 24V DC power supply.

For automotive applications, the electromagnetic relay 10, 100 can be connected to a load circuit including an inductive load, such as a wiper motor, a power window motor, a door lock motor, a cooling fan motor, etc. One exemplary configuration regarding the dimension, shape, material, etc., of the movable terminal member 76 and the size, etc., of the contact gap G, applicable in each of the electromagnetic relays 10 and 100 for automotive use, will be described below.

The electromagnetic relay 10 for DC-12V, which includes the stop member 78, is configured to ensure a contact gap G1 defined by the backstop 72 of, e.g., at least about 0.20 mm and at most about 0.40 mm, in particular of, e.g., about 0.25 mm. On the other hand, the electromagnetic relay 100 for DC-24V, which does not include the stop member 78, is configured to ensure a contact gap G2 defined by the backstop 86 of, e.g., at least about 0.60 mm and at most about 1.4 mm, in particular of, e.g., about 1.1 mm. The difference between G1 and G2 corresponds to the shortest distance between the bottom end face (i.e., the backstop 72) of the protrusion 84 of the stop member 78 and the lower surface (i.e., the backstop 86) of the top wall 48, both being positioned by the first and second sidewalls 44, 46 of the bobbin 30.

The movable terminal member 76 common to the respective electromagnetic relays 10 and 100 is configured so that at least the pair of spring arm parts 76*a* and the pair of bent parts 76*e* are made of a spring material having superior electrical conductivity of at least about 80%. As an example of the material, MZC1-H (a trade name) (Cu—Cr—Zr based copper alloy) available from Mitsubishi Shindoh Co., Ltd. (Tokyo, Japan) may be used. Each spring arm part 76*a* has a thickness of about 0.2 mm (a dimension in a vertical or upward-downward direction in FIG. 1) and a width of about 4 mm (a dimension in a horizontal or rightward-leftward direction in FIG. 1). The length of each spring arm part 76*a* (or the length of a slit between the pair of spring arm parts 76*a*) is, e.g., about 8.75 mm. In FIG. 1, the distance between the center of the right-hand swaged portion of the armature 18 to the horizontal part 76*c* and the center of the right-hand movable contact 70 is, e.g., about 9.75 mm (the left-hand configuration is analogous thereto).

When the movable terminal member 76 made of the above material and having the above size is used, the spring stiffness of the pair of spring arm parts 76*a* during a time when the movable contacts 70 contact the fixed contacts 68 by the operation of the electromagnet 14 (i.e., when "make" contacts are closed) can be set at, e.g., at least about 2N/mm and at most about 3N/mm, in particular at, e.g., about 2.5N/mm. When the spring stiffness of the movable terminal member 76 at the time of closing the "make" contacts is set as above, coil power consumption and heat value in each electromagnetic relay 10, 100 can be suppressed. More specifically, the electromagnetic relay 10 for DC-12V can be driven with coil power consumption of about 450 mW and thus can suppress heat value, so that the electromagnetic relay 10 can operate to close a load circuit carrying an electric current of 60 A (or permit the current to flow through the load circuit) over one hour at an ambient temperature of 25° C. On the other hand, the electromagnetic relay 100 for DC-24V can be driven with coil power consumption of about 800 mW and thus can suppress heat value in comparison with a conventional electromagnetic relay for DC-24V (generally driven with coil power consumption of 1.7 W), so that the electromagnetic relay 10 can operate to close a load circuit carrying an electric current of 30 A (or permit the current to flow through the load circuit) over one hour at an ambient temperature of 25° C.

As will be understood from the above, in the electromagnetic relays 10 and 100, it is possible to construct the movable terminal member 76 in a manner such as to minimize a possible increase in coil power consumption, even if the contact gap G is enlarged, and thereby to suppress an increase in the amount of heat generation in the configuration where the contact gap G is enlarged, even though the fixed terminal member 74 and the movable terminal member 76 are common to the respective electromagnetic relays 10 and 100.

Figure 10:
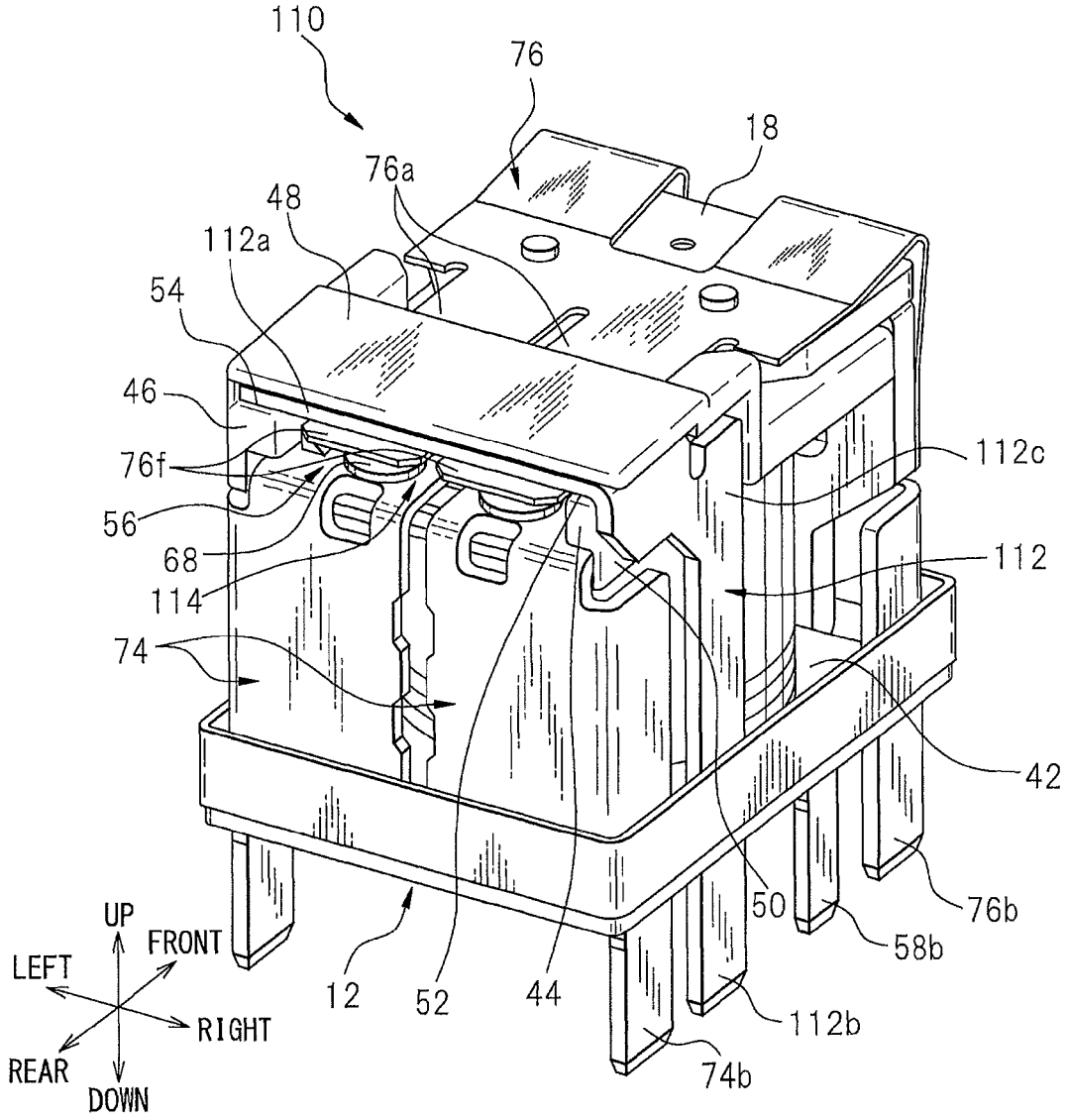
FIG. 10 is a perspective view corresponding to FIG. 2, but depicting an electromagnetic relay according to still another embodiment.
Figure 11:
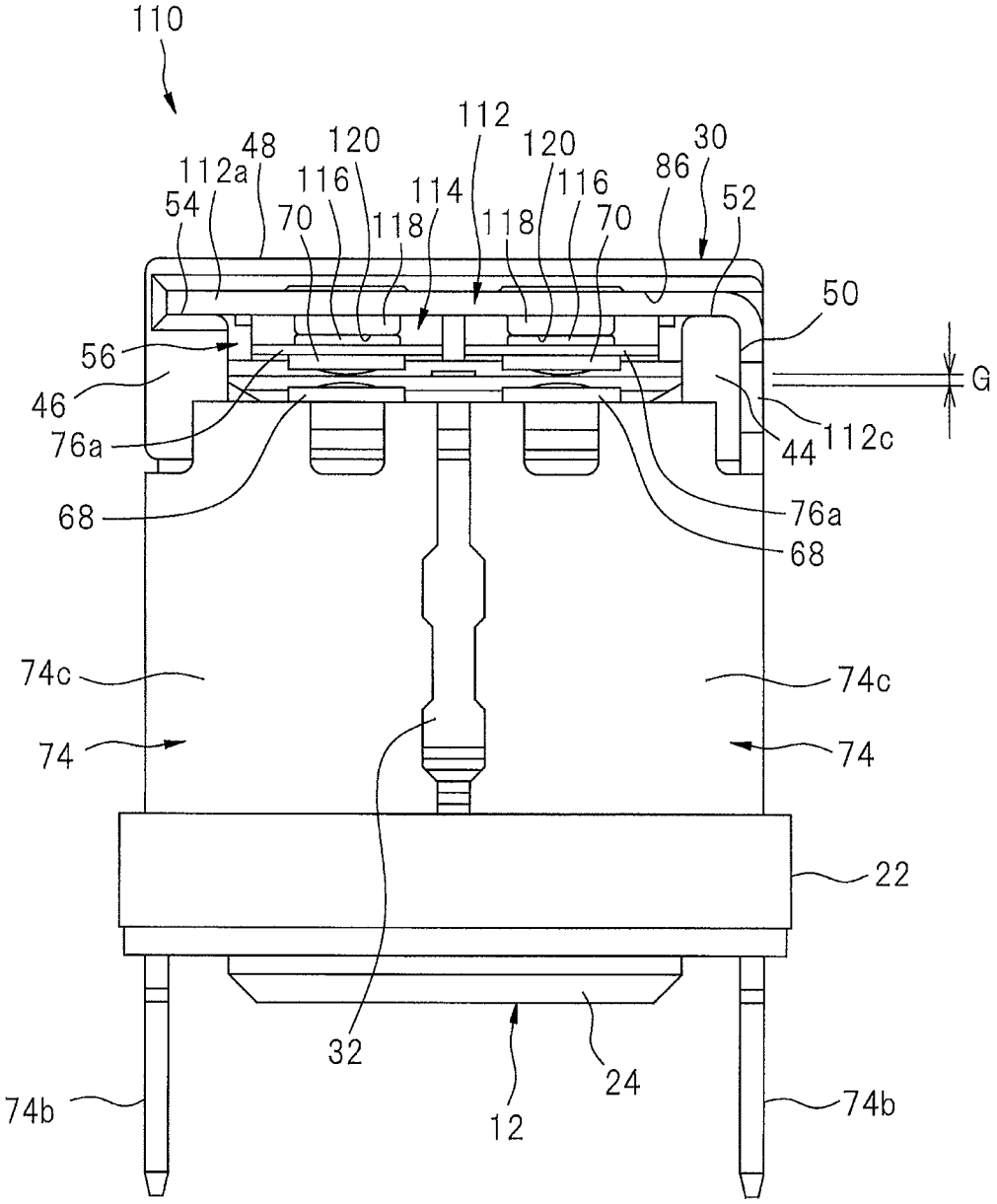
FIG. 11 is a front view depicting the electromagnetic relay of FIG. 10 in a different orientation.

FIGS. 10 and 11 depict an electromagnetic relay 110 according to a further embodiment, in an assembled state with a cover removed. The electromagnetic relay 110 has a configuration substantially identical to that of the electromagnetic relay 10, except that the stop member 78 is replaced with a second fixed terminal member. Therefore, the corresponding components are denoted by the same reference numerals, and detailed descriptions thereof will not be repeated.

The electromagnetic relay 110 is configured to include, instead of the stop member 78 provided in the electromagnetic relay 10, a second fixed terminal member 112 provided separately from the fixed terminal member 74. Thus, the electromagnetic relay 110 includes a base 12, an electromagnet 14, a contact section 114 and an armature 18, as depicted in FIGS. 10 and 11, and also includes a cover 20 as depicted in FIG. 1. The contact section 114 includes, in addition to a pair of fixed contacts 68 and a pair of movable contacts 70, a second pair of movable contacts 116 carried on upper surfaces of a pair of spring arm parts 76*a* of a movable terminal member 76, the upper surfaces being the back sides of the movable contacts 70, and a second pair of fixed contacts 118 disposed opposite respectively to the second movable contacts 116 and capable of individually contacting and separating from the second fixed contacts 118. Each second movable contact 116 may be formed integrally with the movable contact 70 also carried on the same spring arm part 76*a*.

The fixed contact 68 constitutes a normally open contact (i.e., a "make" contact) configured to open when the electromagnet 14 is not energized, the second fixed contact 118 constitutes a normally closed contact (i.e., a "break" contact) configured to be closed when the electromagnet 14 is not energized, and the movable contact 70 and the second movable contact 116 constitute common contacts configured to come into contact respectively with the fixed contact 68 and the second fixed contact 118 in alternating fashion. Accordingly, the contact section 114 has a "break-before-make"

contact (i.e., a transfer contact) configuration in which, when the electromagnet 14 is not energized, the fixed contacts 68 are separated from the movable contacts 70 with the contact gap G defined therebetween while the second movable contacts 116 contact the second fixed contacts 118 and, when the electromagnet 14 is energized, the second movable contacts 116 are separated from the second fixed contacts 118 while the fixed contacts 68 contact the movable contacts 70.

Figure 12:
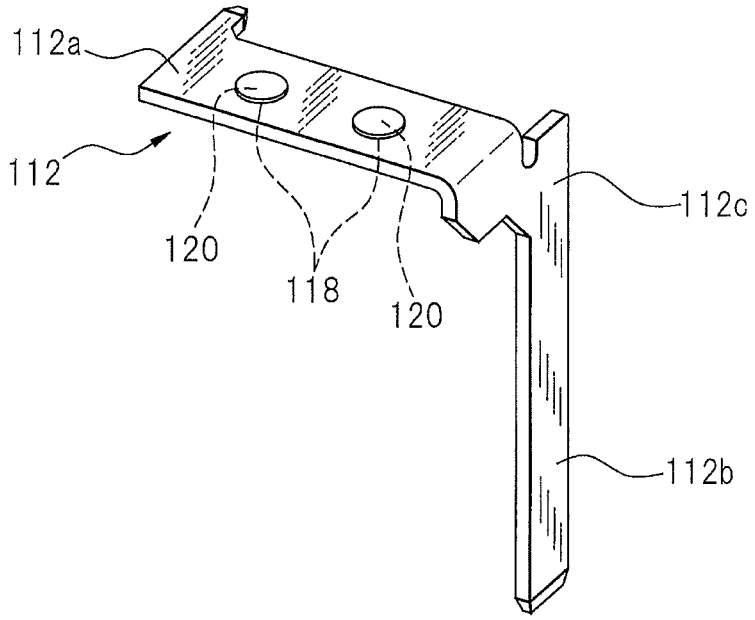
FIG. 12 is an enlarged perspective view depicting one component of the electromagnetic relay of FIG. 10.

The second pair of fixed contacts 118 is provided on the second fixed terminal member 112. In the assembled state of the electromagnetic relay 110, the second fixed terminal members 112 are disposed on the base 12 and electrically insulated from a coil 32 of the electromagnet 14. As depicted enlarged in FIG. 12, the second fixed terminal member 112 includes at one end thereof an arm part 112*a* carrying on the lower surface thereof the second pair of fixed contacts 118, at the other end thereof a leg part 112*b* adapted to be connected to a load circuit (not depicted) to be opened or closed by the electromagnetic relay 110, and an intermediate part 112*c* extending between the arm part 112*a* and the leg part 112*b*. The leg part 112*b* and the intermediate part 112*c* of the second fixed terminal member 112 extend in a vertical or upward-downward direction substantially parallel to a center axis 32*a* of the coil 32 (FIG. 4) at a predetermined position on the right of the electromagnet 14.

The arm part 112*a* of the second fixed terminal member 112 has size and shape substantially identical to those of the major part 80 of the stop member 78 provided in the aforementioned electromagnetic relay 10, and the intermediate part 112*c* of the second fixed terminal member 112 has a size and shape substantially identical to those of the auxiliary part 82 of the stop member 78. Accordingly, the arm part 112*a* of the second fixed terminal member 112 is fixedly attached, in the same manner as the major part 80 of the stop member 78, to first and second sidewalls 44, 46 (i.e., a backstop positioner) formed upright on a first flange 40 of a bobbin 30 of the electromagnet 14. More specifically, as depicted in FIG. 10, the arm part 112*a* is fixed to the first and second sidewalls 44, 46 by press-fitting the right end portion thereof adjacent to the intermediate part 112*c* into a slit 52 formed in the first sidewall 44 and the left end portion thereof farthest from the intermediate part 112*c* into a groove 54 formed in the second sidewall 46.

In the above attached state, the arm part 112*a* of the second fixed terminal member 112 is accommodated in a contact accommodating portion 56 provided on the first flange 40, and is fixedly disposed between a top wall 48 extending between the first and second sidewalls 44, 46 and free end regions 76*f* of the pair of spring arm parts 76*a* of the movable terminal member 76 accommodated in the contact accommodating portion 56. The upper surface of the arm part 112*a* of the second fixed terminal member 112 abuts on the lower surface of the top wall 48. Further, in the above attached state, the intermediate part 112*c* of the second fixed terminal member 112 is fixedly received in a depression 50 formed on the outer surface of the first sidewall 44.

The leg part 112*b* of the second fixed terminal member 112 penetrates through one support hole (not depicted) formed at an intermediate position in a frontward-rearward direction of a bottom part 24 of the base 12 and protrudes downward from the base 12. The leg part 112*b* of the second fixed terminal member 112 is fixed to the base 12 by press-fitting the leg part 112*b* into the support hole previously formed in the base 12. The second fixed terminal member 112 including the arm part 112*a*, the leg part 112*b* and the intermediate part 112*c* is formed as a unitary or one-piece structure by, e.g., punching and bending a metal plate having good electrical conductivity into a predetermined shape. Each second fixed contact 118 is formed from a suitable contact material, and is fixed to the lower surface of the arm part 112*a* of the second fixed terminal member 112 by, e.g., swaging.

The lower surface of each second fixed contact 118 disposed opposite to the counterpart second movable contact 116 constitutes a backstop 120 for stopping movement of the first movable contact 70 in a direction separating from the counterpart first fixed contact 68 and thereby defining a predetermined contact gap G (FIG. 10) between the first fixed contact 68 and the first movable contact 70. The backstop 120 is set at a position where the backstop 120 is opposed, in a contactable and separable relationship, to the second movable contact 116 carried on the movable contact member 76.

When the electromagnet 14 is not energized, the pair of second movable contacts 116 accommodated in the contact accommodating portion 56 are abutted on the lower surfaces of the pair of second fixed contacts 118, i.e., the backstop 120, by the spring force exerted by bent parts 76*e* of the movable terminal member 76. In this state, the backstop 120 acts to stop upward movement of each spring arm part 76*a* caused by the spring force generated by the movable terminal member 76, in other words, movement of the first movable contact 70 carried on each spring arm part 76*a* in a direction separating from the counterpart first fixed contact 68, and thereby defines a predetermined contact gap G (FIG. 10) between the mutually opposed first fixed and movable contacts 68, 70. In the state where upward movement of the movable contact 70 relative to the fixed contact 68 is stopped by the backstop 120, each spring arm part 76*a* of the movable terminal member 76 is elastically bent while the second movable contact 116 is abutted on the backstop 120 by the spring force of the bent part 76*e*, and the second movable contact 116 is pressed onto the backstop 120 (i.e., the lower surface of the second fixed contact 118) by the elastic restoring force of the spring arm part 76*a*. As a result, the contact gap G is stably maintained in a predetermined size depending on the position of the backstop 120 relative to the first fixed contact 68.

In the electromagnetic relay 110, in the state where movement of the first movable contact 70 is stopped by the backstop 120, different-sized contact gaps G can be defined between the first fixed contact 68 and the first movable contact 70, depending on the position of the backstop 120 set by the backstop positioner, in a manner analogous to the configuration of the aforementioned electromagnetic relay 10 wherein the different-sized contact gaps G is defined depending on the position of the backstop 72. For example, the electromagnetic relay 110 may have a configuration wherein the second fixed terminal member 112 is optionally not attached to the bobbin 30 in the manufacturing process of the electromagnetic relay 110, and the lower surface of the top wall 48 of the bobbin 30 is used as a second backstop 86. More specifically, the configuration of the electromagnetic relay 110 may be modified as needed by omitting the second fixed terminal member 112, in other words, by changing the transfer contact configuration to a monostable-type normally-open (or make) contact configuration, and thereby changing the first backstop 120 to the second backstop 86, so that the size of the contact gap G is changed accordingly. The second backstop 86 constituted by the lower surface of the top wall 48 is set at a position where the second backstop 86 is opposed, in a contactable and separable relationship, to the second movable contacts 116 carried on the free end regions 76*f* of the pair of spring arm parts 76*a* of the movable terminal member 76.

In this configuration, it is preferred to previously choose the dimensions, shapes, materials, etc., of the movable terminal member 76 so as to ensure the configuration wherein, even when the first backstop 120 is changed to the second backstop 86, the second movable contact 116 carried on each spring arm part 76*a* of the movable terminal member 76 is pressed onto the second backstop 86 by the elastic force of the spring arm part 76*a* as described above and thereby the contact gap G is reliably defined so as to correspond to the position of the second backstop 86. In this configuration, the first and second sidewalls 44, 46 of the bobbin 30, provided at the upper ends thereof with the top wall 48, function as the backstop positioner capable of setting not only the first backstop 120 at a first position for defining the contact gap G having a first size but also the second backstop 86 at a second position for defining the contact gap G having a second size different from the first size.

As described above, in the electromagnetic relay 110, it is possible to change the size of the contact gap G by choosing whether the second fixed terminal member 112 is attached or not, in the manufacturing process of the electromagnetic relay 110. Therefore, according to the electromagnetic relay 110, only by way of design change concerning the provision of the second fixed terminal member 112, it is possible to manufacture a electromagnetic relay 110 of a type ensuring a contact gap G defined appropriately for an electric voltage or current applied to a load circuit (not depicted) to be opened or closed by the electromagnetic relay 110. In particular, since the electromagnetic relay 110 is configured so that predetermined different-sized contact gaps G are defined depending on the position of the backstop 120 (86) provided for stopping movement of the movable contact 70 in a direction separating from the fixed contact 68, the movable contact 70 is stably held by the backstop 120 (86) at a predetermined position relative to the fixed contact 68 during a contact open state, and thus the contact gap G is stably maintained at a predetermined size. Accordingly, in the electromagnetic relay 110, it is possible to address changes in an electric voltage or current applied to a load circuit while ensuring a stable opening and closing operation of a contact, by way of minimum design change.

An electromagnetic relay according to the present invention is not limited to the aforementioned embodiments.

For example, the first and second sidewalls 44, 46 of the bobbin 30 may be provided respectively with a plurality of slits 52 and grooves 54 at a plurality of positions different in height from the first flange 40. In this configuration, the stop member 78 or the second fixed terminal member 112 can be attached to one slit 52 and one groove 54 at a desired height, selected from among the plurality of slits 52 and grooves 54, so as to determine the position of the backstop 72 or 120, and thereby it is possible to define the contact gap G corresponding to the determined position of the backstop position. Further, the top wall 48 may be omitted, and the stop member 78 or the second fixed terminal member 120 may be selectively attached to the upper ends of the first and second sidewalls 44, 46, instead of being attached to the slit 52 and the groove 54.

A structure for attaching the stop member 78 to the first and second sidewalls 44, 46 is not limited to the combination of the slit 52 and the groove 54. For example, both the first and second sidewalls 44, 46 may be provided with the slits 52. If the auxiliary part 82 of the stop member 78 is omitted, both the first and second sidewalls 44, 46 may be provided with the grooves 54. Further, other suitable fastening means, such as adhesive, bolt, etc., may be employed for attaching the stop member 78.

A backstop positioner is not limited to the first and second sidewalls 44, 46 of the bobbin 30. A backstop positioner may be provided in any suitable members, provided that a backstop positioner can set a backstop at a position for defining a predetermined contact gap G between the fixed contact 68 and the movable contact 70. For example, a member including a backstop (e.g., the backstop 72, 86, 120) may be attached directly to the base 12 in a manner such that the backstop can be selectively set at various positions at different heights from the bottom part 24. In this configuration, the backstop positioner is provided in the base 12.

A backstop is not limited to the backstop 72, 86, 120. For example, a backstop may be provided in any suitable member, such as the cover 20, provided that a backstop can stop movement of the movable contact 70 in a direction separating from the fixed contact 68, and thus can define a predetermined contact gap G between the fixed contact 68 and the movable contact 70.

Components other than a backstop and a backstop positioner, i.e., a base, an electromagnet, a fixed contact, a movable contact, an armature, a cover, etc., are also not limited to the base 12, the electromagnet 14, the fixed contact 68, the movable contact 70, the armature 18, the cover 20, etc. Various configurations can be employed for these components, provided that different-sized contact gaps can be defined between the fixed contact and the movable contact, depending on the position of the backstop. For example, a configuration wherein a single fixed contact 68 and a single movable contact 70 are provided, or a configuration wherein three or more fixed contacts 68 and three or more movable contacts 70 are provided, may be employed.

Figure 13:
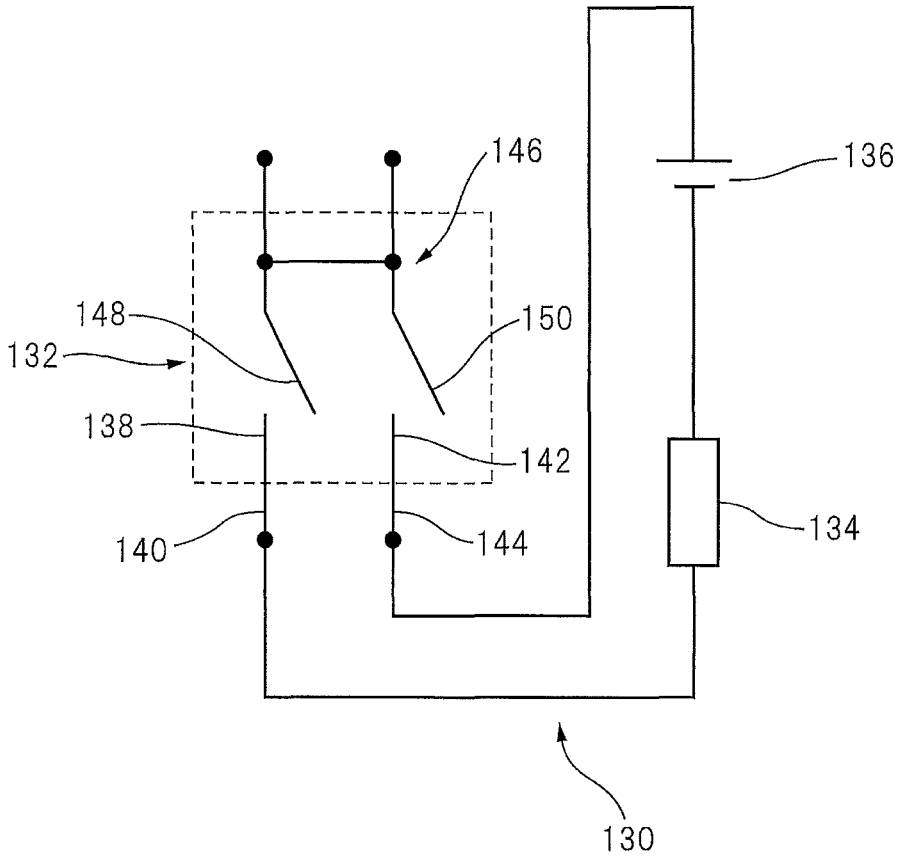
FIG. 13 is a circuit diagram depicting an electric circuit according to one embodiment.

FIG. 13 depicts an electric circuit 130 according to one embodiment. The electric circuit 130 includes a single electromagnetic relay 132, a load 134 and a power supply 136. The electromagnetic relay 132 may be one of the electromagnetic relays 10, 100, 110 described above, or may be another electromagnetic relay.

The electromagnetic relay 132 includes a first terminal 140 provided with a first contact 138 and a second terminal 144 provided with a second contact 142. The first and second contacts 138, 142 are configured as fixed contacts that remain immovable regardless of the operating state of an electromagnet (not depicted). The electromagnetic relay 132 further includes a short-circuiting member 146 capable of coming into contact, in a separable manner, with the first and second contacts 138, 142 and thereby electrically connecting the first and second terminals 140, 144 to each other. The short-circuiting member 146 includes a first movable contact 148 disposed to be capable of contacting and separating from the first contact 138, and a second movable contact 150 disposed to be capable of contacting and separating from the second contact 142. The first and second movable contacts 148, 150 are electrically connected to each other. When the electromagnet is energized, the first and second movable contacts 148, 150 come into contact with or are separated from the first and second contacts 138, 142, respectively.

In the electric circuit 130, the first terminal 140, the second terminal 144, the short-circuiting member 146, the load 134 and the power supply 136 are mutually connected in series as a whole (this connection configuration is hereinafter referred to as a series connection configuration). The short-circuiting member 146 may be formed as a single movable terminal provided with the first and second movable contacts 148, 150, which is a component of the electromagnetic relay 132.

Although not depicted, the electromagnetic relay 132 may be used in a manner such that the first and second terminals 140, 144 and the short-circuiting member (or movable terminal) 146 are connected to the load 134 and the power supply 136, regardless of the make-brake condition of the contacts, and that a first make-break contact pair including the first contact 138 and the first movable contact 148 and a second make-break contact pair including the second contact 142 and the second movable contact 150 are connected in parallel with each other (this connection configuration is hereinafter referred to as a parallel connection configuration). According to the parallel connection configuration, it is possible to improve contact reliability when the fixed contacts 138, 142 and the movable contacts 148, 150 are closed, and also to reduce the amount of heat generation in the contacts.

On the other hand, the electric circuit 130 having the series connection configuration depicted in FIG. 13 is configured so that the short-circuiting member (or movable terminal) 146 is not connected to the load 134 when the contacts open, and a series connection of the first terminal 140, the first contact 138, the first movable contact 148, the short-circuiting member (or movable terminal) 146, the second movable contact 150, the second contact 142 and the second terminal 144 in this order is established in the electromagnetic relay 132 when the contacts are closed. According to the series connection configuration as depicted, since a contact gap between the first contact 138 and the first movable contact 148 and a contact gap between the second contact 142 and the second movable contact 150 are arranged in series, it is possible to double a contact gap between mutually opposing contacts in the circuit, in comparison with that in the parallel connection configuration.

Therefore, according to the electric circuit 130, even when the power supply 136 is configured to apply a relatively large voltage, or when the load 134 is an inductive load, the electric circuit 130 can be safely opened by the electromagnetic relay 132. For example, in the case where the electromagnetic relay 132 is designed to be able to safely interrupt a voltage of DC-12V applied to an electric circuit in which the electromagnetic relay 132 is arranged in the parallel connection configuration, it is possible for the electromagnetic relay 132 having the same design to safely interrupt a voltage of DC-24V applied to the electric circuit 130 in which the electromagnetic relay 132 is arranged in the series connection configuration. Accordingly, the electric circuit 130 can address changes in an electric voltage or current applied to the circuit while ensuring a stable opening and closing operation of the contact in the electromagnetic relay 132, by way of minimum design change to the electromagnetic relay 132 between the parallel connection configuration and the series connection configuration in the circuit.

FIG. 14 depicts an electric circuit 160 according to another embodiment. The electric circuit 160 includes two electromagnetic relays 132, a load 134 and a power supply 136. In the electric circuit 160, components corresponding to those of the electric circuit 130 are denoted by the same reference numerals, and detailed descriptions thereof will not be repeated.

Figure 14A:
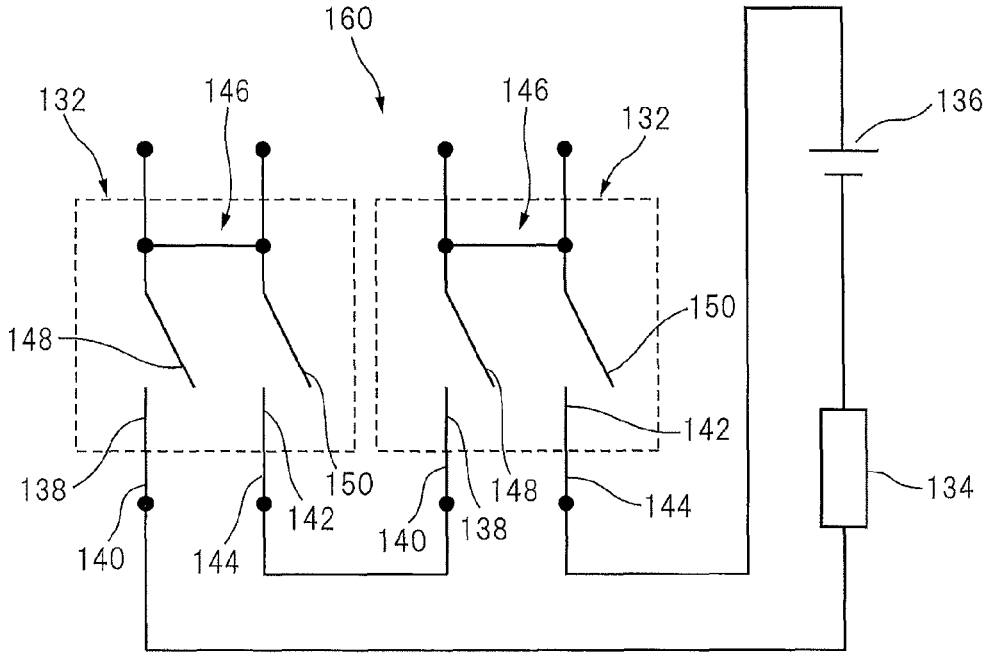
FIG. 14A is a circuit diagram depicting an electric circuit according to another embodiment.
Figure 14B:
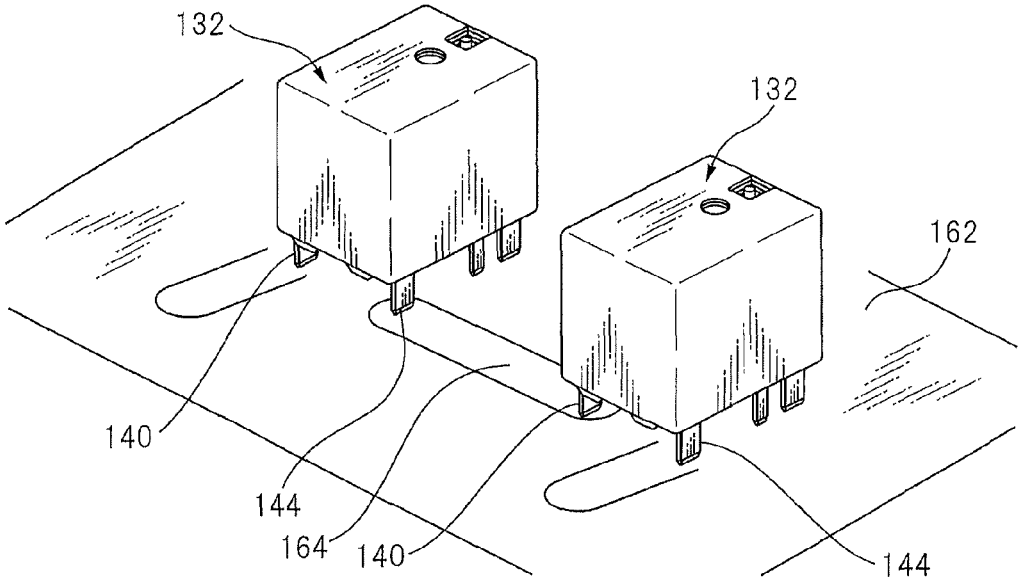
FIG. 14B is a diagrammatic perspective view depicting the electric circuit of FIG. 14A.

As depicted in FIG. 14A, in the electric circuit 160, the first terminal 140 in one electromagnetic relay 132 is connected to the second terminal 144 in the other electromagnetic relay 132. FIG. 14B diagrammatically illustrates a circuit board 162 and conductors 164 for implementing such a connection configuration. In the electric circuit 160 having the connection configuration as depicted, it is possible to further double the contact gap between mutually opposing contacts, in comparison with that in the electric circuit 130. Therefore, according to the electric circuit 160, even when the power supply 136 is configured to apply a relatively large voltage, or when the load 134 is an inductive load, the electric circuit 160 can be safely opened by the pair of electromagnetic relays 132. It should be noted that an electric circuit according to the present invention may include three or more electromagnetic relays 132 and may be configured in a manner such that the first terminal 140 or second terminal 144 in one electromagnetic relay 132 is connected to the first terminal 140 or second terminal 144 in the other electromagnetic relay 132.

The aforementioned electromagnetic relay 10, 100, 110 can be employed as the electromagnetic relay 132 in the electric circuit 130, 160. In this case, the first and second terminals 140, 144 correspond to the pair of fixed terminal members 74 in the electromagnetic relay 10, 100, 110, while the short-circuiting member (or movable terminal) 146 corresponds to the movable terminal member 76 in the electromagnetic relay 10, 100, 110. Alternatively, instead of the electromagnetic relay 132, an electromagnetic relay including a single fixed terminal provided with first and second fixed contacts, a first movable terminal provided with a first movable contact, and a second movable terminal provided with a second movable contact, in which the fixed terminal is used as a short-circuiting member and is not connected to a load circuit when the contacts open, may be used in an inventive electric circuit.

While the invention has been described with reference to specific embodiments, it will be understood by those skilled in the art that various changes and modifications may be made thereto without departing from the scope of the following claims.

The invention claimed is:

1. An electromagnetic relay comprising:

an electromagnet;

a first contact that includes a first movable contact to be actuated by the electromagnet, and a first fixed contact facing the first movable contact and capable of contacting and separating from the first movable contact;

a second contact that is disposed side by side with the first contact, and includes a second movable contact to be actuated by the electromagnet, and a second fixed contact facing the second movable contact and capable of contacting and separating from the second movable contact; and a backstop positioner to which a stop member is attachable, the backstop positioner including a first positioner provided at a side close to the first contact, and a second positioner provided at a side close to the second contact;

wherein the stop member attachable to the backstop positioner includes a main portion that extends toward a direction in which the first contact and the second contact are aligned, and wherein one end of the main portion is attached to the first positioner, and another end of the main portion is attached to the second positioner.

2. The electromagnetic relay of claim 1, further comprising:

backstops provided on the main portion, wherein each of the backstops corresponds to one of the first movable contact and the second movable contact, respectively, and defines a contact gap between the corresponding fixed contact and the corresponding movable contact, and wherein contact gaps between fixed contacts and corresponding movable contacts defined in a condition where the stop member is attached to the backstop positioner is smaller than contact gaps between the fixed contacts and the corresponding movable contacts defined in a condition where the stop member is not attached to the backstop positioner.

3. The electromagnetic relay of claim 1, wherein the first positioner is a first slit into which one end of the main portion is to be inserted, and wherein the second positioner is a second slit into which another end of the main portion is to be inserted.

4. The electromagnetic relay of claim 1, further comprising:

a top wall provided over the first movable contact and the second movable contact, wherein a gap between the top wall and the first and the second movable contacts is larger than a gap between the stop member and the first and the second movable contacts.

5. The electromagnetic relay of claim 1, further comprising:

a short-circuiting member capable of coming into contact with the first contact and the second contact in a separable manner and electrically interconnecting a first terminal and a second terminal.

* * * * *